US010400802B2

(12) United States Patent
Sugano

(10) Patent No.: US 10,400,802 B2
(45) Date of Patent: Sep. 3, 2019

(54) HYDRAULIC DRIVE DEVICE

(71) Applicant: Kobe Steel, Ltd., Hyogo (JP)

(72) Inventor: Naoki Sugano, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 164 days.

(21) Appl. No.: 15/324,818

(22) PCT Filed: Jul. 31, 2015

(86) PCT No.: PCT/JP2015/071809
§ 371 (c)(1),
(2) Date: Jan. 9, 2017

(87) PCT Pub. No.: WO2016/017802
PCT Pub. Date: Feb. 4, 2016

(65) Prior Publication Data

US 2017/0198731 A1 Jul. 13, 2017

(30) Foreign Application Priority Data

Aug. 1, 2014 (JP) ..... 2014-157865
Nov. 20, 2014 (JP) ..... 2014-235334

(51) Int. Cl.
*F15B 21/14* (2006.01)
*E02F 9/22* (2006.01)
(Continued)

(52) U.S. Cl.
CPC ..... *F15B 21/14* (2013.01); *E02F 9/2217* (2013.01); *E02F 9/2228* (2013.01);
(Continued)

(58) Field of Classification Search
CPC ..... E02F 9/2289; E02F 9/2217; E02F 9/2228; E02F 9/2235; E02F 9/2232; E02F 9/2267;
(Continued)

(56) References Cited

U.S. PATENT DOCUMENTS 4,616,476 A 10/1986 Oneyama et al.
2005/0196288 A1 9/2005 Cherney
(Continued)

FOREIGN PATENT DOCUMENTS

CN 101225845 A 7/2008
CN 101387309 A 3/2009
(Continued)

OTHER PUBLICATIONS

Extended European Search Report issued by the European Patent Office dated Feb. 8, 2018, which corresponds to EP15827312.8-1018 and is related to U.S. Appl. No. 15/324,818.
(Continued)

*Primary Examiner* — Abiy Teka
(74) *Attorney, Agent, or Firm* — Studebaker & Brackett PC

(57) ABSTRACT

A hydraulic drive apparatus includes: an accumulator for receiving hydraulic fluid discharged from a hydraulic actuator during a lowering drive; an accumulator flow regulator capable of changing a flow rate of hydraulic fluid to be introduced to the accumulator from a closed circuit; a regeneration actuator for converting energy of the hydraulic fluid accumulated in the accumulator into motive force; a regeneration selector valve interposed between the accumulator and the regeneration actuator; a pump control section for limiting a pump discharge flow rate during the lowering drive; and a speed control section for operating the accumulator-flow-rate regulator so as to bring an actuating speed of the hydraulic actuator close to a target speed during the lowering drive.

9 Claims, 11 Drawing Sheets

(51) Int. Cl.

| | |
|---|---|
| ***F15B 1/02*** | (2006.01) |
| ***F15B 1/033*** | (2006.01) |
| ***F15B 11/16*** | (2006.01) |
| *E02F 9/20* | (2006.01) |

(52) U.S. Cl.
CPC ..... *E02F 9/2232* (2013.01); *E02F 9/2235* (2013.01); *E02F 9/2267* (2013.01); *E02F 9/2271* (2013.01); *E02F 9/2289* (2013.01); *F15B 1/024* (2013.01); *F15B 1/033* (2013.01); *F15B 11/16* (2013.01); *E02F 9/2016* (2013.01); *F15B 2211/212* (2013.01); *F15B 2211/255* (2013.01); *F15B 2211/6306* (2013.01); *F15B 2211/6654* (2013.01); *F15B 2211/88* (2013.01)

(58) Field of Classification Search
CPC ..... F15B 21/14; F15B 1/033; F15B 1/024; F15B 11/16
See application file for complete search history.

(56) References Cited

U.S. PATENT DOCUMENTS

| | | | | |
|---|---|---|---|---|
| 2008/0110166 | A1 | 5/2008 | Stephenson et al. | |
| 2009/0071145 | A1 | 3/2009 | Kim | |
| 2013/0098012 | A1* | 4/2013 | Opdenbosch ..... | F15B 1/024 60/327 |
| 2013/0098016 | A1 | 4/2013 | Opdenbosch et al. | |
| 2013/0318955 | A1 | 12/2013 | Zhang et al. | |
| 2015/0192148 | A1* | 7/2015 | Nanyoshi ..... | F15B 21/14 60/414 |
| 2015/0292183 | A1 | 10/2015 | Hiraku | |

FOREIGN PATENT DOCUMENTS

| | | | |
|---|---|---|---|
| JP | S57-000102 | U | 1/1982 |
| JP | H11-002212 | A | 1/1999 |
| JP | 2005-249198 | A | 9/2005 |
| JP | 2007-010006 | A | 1/2007 |
| JP | 2013-117098 | A | 6/2013 |
| WO | 2014/109131 | A1 | 7/2014 |

OTHER PUBLICATIONS

Notification of Transmittal of Translation of the International Preliminary Report on Patentability and English translation of the Written Opinion of the International Searching Authority; PCT/JP2015/071809 dated Feb. 16, 2017; 6pp.
International Search Report issued in PCT/JP2015/071809; dated Nov. 2, 2015.

* cited by examiner

HYDRAULIC DRIVE DEVICE

TECHNICAL FIELD

The present invention relates to a hydraulic drive apparatus. More specifically, the present invention relates to an apparatus for hydraulically driving a load in a construction machine or the like.

BACKGROUND ART

Conventionally, a generally known apparatus for driving a load in a construction machine or the like includes a hydraulic actuator connected to the load, a hydraulic pump which discharges hydraulic fluid for causing the hydraulic actuator to move, and a control valve interposed between the hydraulic pump and the hydraulic actuator. This control valve controls supply and discharge of hydraulic fluid from the hydraulic pump to the hydraulic actuator. This apparatus is based on so-called an open circuit in which hydraulic fluid contained in a tank is sucked by the hydraulic pump and supplied to the hydraulic actuator through the control valve, and the hydraulic fluid discharged from the hydraulic actuator is returned to the tank through the control valve.

In contrast to this open circuit type apparatus, Japanese Unexamined Patent Application Publication No. 2013-117098, namely, Patent Literature 1, discloses a so-called closed circuit type of hydraulic drive apparatus. The apparatus includes a variable displacement type hydraulic pump and a hydraulic actuator. The hydraulic pump and the hydraulic actuator are connected to each other so as to configure a closed circuit in which hydraulic fluid discharged from the hydraulic pump moves the hydraulic actuator while circulating in the closed circuit. The apparatus, involving a control of a speed of the hydraulic actuator by regulation of a displacement volume or rotational speed of the hydraulic pump, does not require a control valve as described above. The apparatus, thus, has an advantage of involving no motive power loss caused by pressure loss in the control valve to save energy.

There exists a hydraulic drive apparatus required to actuate a load in a direction in which gravity acts on the load, namely, a lowering direction, such as a hydraulic winch provided in a crane or an apparatus for actuating a boom or an arm in a hydraulic excavator. Regarding such a drive in the lowering direction, it is an important issue to recover kinetic energy and potential energy of the load, that is, efficiently regenerate, while applying an appropriate brake force to a falling load and a hydraulic actuator connected to the load to control a speed thereof in the lowering direction to an appropriate speed.

However, in the case of driving a hydraulic actuator, which is required to perform such a lowering direction drive, in a so-called closed circuit apparatus as described above, no means has been presented for efficiently recovering kinetic energy and potential energy of the load while appropriately controlling a speed in the lowering direction.

Patent Literature 1 discloses a technique, based on the premise that the hydraulic actuator is a variable displacement type hydraulic motor, of regulating the displacement volume of the variable displacement type hydraulic motor to thereby control a brake torque. However, this technique, depending on a capability of varying displacement of the hydraulic motor, is not applicable to the case where the hydraulic actuator has no capability of varying displacement as in the case where the hydraulic actuator is a hydraulic cylinder or a fixed displacement type hydraulic pump.

SUMMARY OF INVENTION

In view of such circumstances, the present invention aims to provide a hydraulic drive apparatus capable of driving a load in a lowering direction which is the same as a direction in which gravity acts on the load, by using a hydraulic actuator, the apparatus being able to efficiently regenerate energy while controlling a speed in the lowering direction, irrespective of whether the hydraulic actuator has a capability of varying displacement or not.

The inventors of the present invention have conceived to adopting, as the means for regeneration, an accumulator which accumulates a part of hydraulic fluid returning from a hydraulic actuator to a hydraulic pump in a closed circuit during a lowering drive. In addition, the present inventors have conceived that regulation of the flow rate of hydraulic fluid supplied from the closed circuit to the accumulator enables the speed of the hydraulic actuator in a lowering direction, in turn, a speed of a load, to be controlled. In summary, the present inventors have conceived that the use of the accumulator enables both of effective regeneration and speed control during a lowering drive to be realized with simple configuration.

The present invention has been made in view of the above circumstances. The present invention provides a hydraulic drive apparatus for hydraulically actuating a load, the hydraulic drive apparatus including: a hydraulic actuator which is connected to the load and is operated so as to actuate the load; a hydraulic pump configured to discharge hydraulic fluid and having a variable flow rate, the hydraulic pump being connected to the hydraulic actuator so as to configure a closed circuit in which hydraulic fluid discharged from the hydraulic pump is supplied to the hydraulic actuator and hydraulic fluid discharged from the hydraulic actuator is returned to a suction side of the hydraulic pump; a drive source which drives the hydraulic pump to cause the hydraulic pump to discharge hydraulic fluid; a charge circuit which feeds supplemental hydraulic fluid to the closed circuit when a pressure in the closed circuit is lower than a predetermined set pressure; an accumulator connected to the closed circuit so as to be able to receive hydraulic fluid discharged from the hydraulic actuator during a lowering drive in which the hydraulic actuator is operated so as to actuate the load in a lowering direction including a component of a direction in which gravity acts on the load; an accumulator-flow-rate regulator interposed between the closed circuit and the accumulator to change a flow rate of hydraulic fluid from the closed circuit to the accumulator; a regeneration actuator which is driven by energy of hydraulic fluid accumulated by the accumulator to convert the energy into motive power; a regeneration selector valve interposed between the accumulator and the regeneration actuator and being switchable between a position for allowing hydraulic fluid to be supplied from the accumulator to the regeneration actuator and a position for cutting off the supply; a pump control section which limits the discharge flow rate of the hydraulic pump to a predetermined regeneration flow rate during the lowering drive; and a speed control section which operates the accumulator-flow-rate regulator so as to bring an actuating speed of the hydraulic actuator close to a target speed during the lowering drive.

DESCRIPTION OF EMBODIMENTS

Preferred embodiments of the present invention will be described with reference to the drawings.

Figure 1:
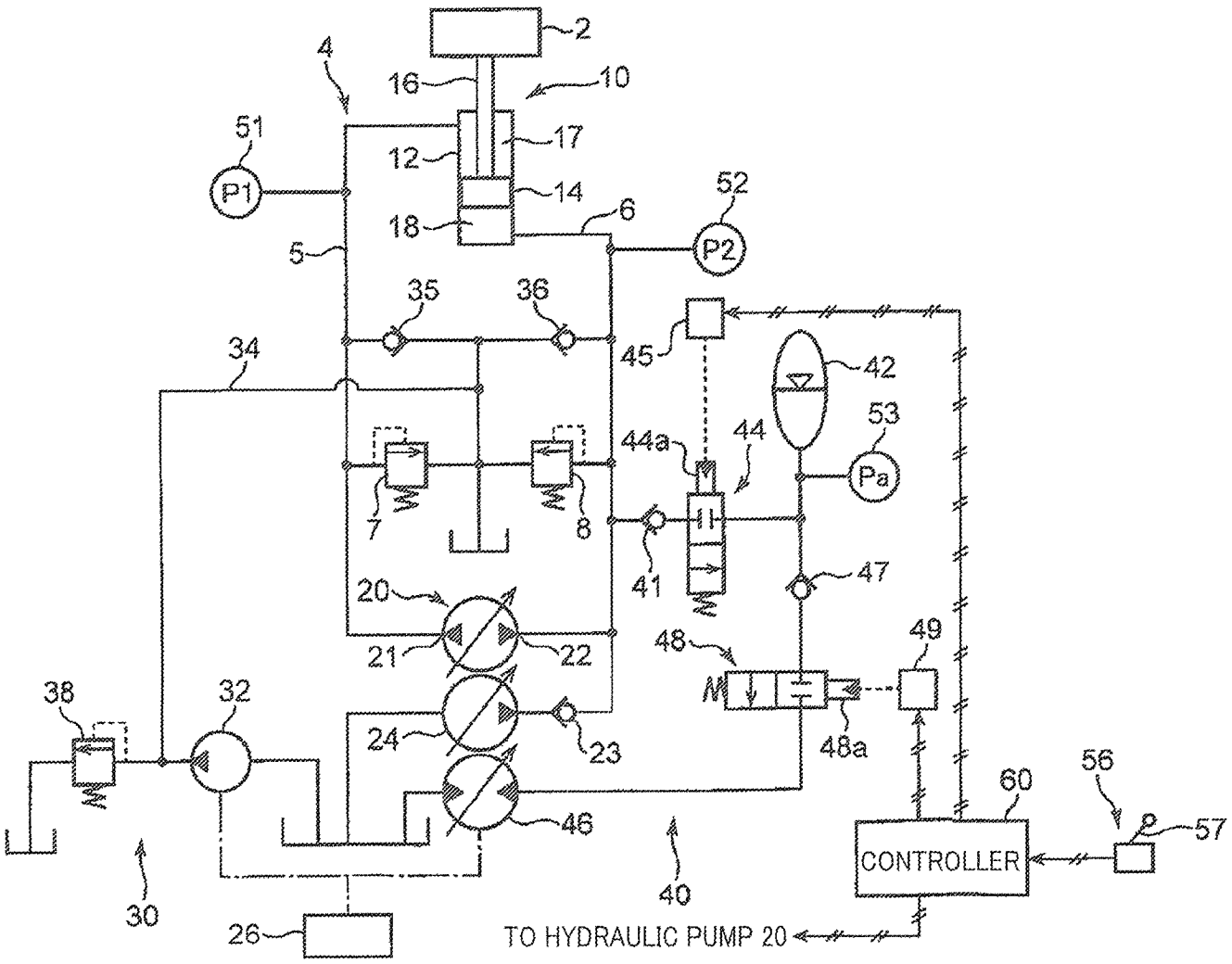
FIG. 1 is a circuit diagram showing a hydraulic drive apparatus according to a first embodiment of the present invention.

FIG. 1 shows a hydraulic drive apparatus according to a first embodiment of the present invention. The hydraulic drive apparatus is an apparatus for hydraulically actuating a load 2, including a hydraulic cylinder 10 as a hydraulic actuator, a hydraulic pump 20 for supplying hydraulic fluid to the hydraulic cylinder 10, an auxiliary hydraulic pump 24, a drive source 26 for driving the hydraulic pumps 20, 24, a charge circuit 30, a regeneration circuit 40, a plurality of pressure sensors 51, 52, 53, a manipulation device 56 and a controller 60.

The hydraulic cylinder 10 is connected to the load 2 so as to actuate the load 2. The hydraulic cylinder 10 is, for example, a boom cylinder which raises and lowers a boom of a hydraulic excavator; in this case, the boom corresponds to the load 2. Application of the hydraulic cylinder 10 is not limited thereto but is widen so as to encompass anyone that actuates the load 2 in a lowering direction including a component of a direction in which gravity acts on the load 2, i.e., in a downward direction or in an obliquely downward direction. Besides, the hydraulic actuator according to the present invention is not limited to the hydraulic cylinder 10 but permitted to be another one, for example, a hydraulic motor. When the hydraulic motor is used for driving a winch drum of a hydraulic winch in a crane, what corresponds to the load 2 is a suspended load of the hydraulic winch.

The hydraulic cylinder 10 shown in FIG. 1 has a cylinder body 12, a piston 14 loaded in the cylinder body 12, and a rod 16 coupled to the piston 14, the rod 16 having a front end to be connected to the load 2. The piston 14 partitions an inner space of the cylinder body 12 into a rod side chamber 17 on the side of the rod 16 and a head side chamber 18 on the opposite side thereto.

The hydraulic cylinder 10 according to this embodiment is disposed such that the rod 16 extends upward. Hence, the hydraulic cylinder 10 extends by receiving a supply of hydraulic fluid to the head side chamber 18 and discharging the hydraulic fluid from the rod side chamber 17 to thereby actuate the load 2 in a raising direction which is a direction opposite to gravity acting on the load 2. Conversely, the hydraulic cylinder 10 contracts by receiving a supply of hydraulic fluid to the rod side chamber 17 and discharging the hydraulic fluid from the head side chamber 18 to thereby actuating the load 2 in the lowering direction which is the same as the direction in which gravity acts on the load 2. The direction of the hydraulic cylinder 10 may be reversed.

The hydraulic pump 20 is driven by the drive source 26 to discharge hydraulic fluid and supply the same to the hydraulic cylinder 10. The hydraulic pump 20 further has a capability of switching a rotational direction thereof and varying a discharge flow rate thereof. Specifically, the hydraulic pump 20 according to this embodiment is configured with a variable displacement type hydraulic pump having a tilt angle changeable to both forward and backward directions.

The hydraulic pump 20 is connected to the hydraulic cylinder 10 so as to configure a closed circuit 4 in which hydraulic fluid discharged from the hydraulic pump 20 is supplied to the hydraulic cylinder 10 and the hydraulic fluid discharged from the hydraulic cylinder 10 is returned to a suction side of the hydraulic pump 20. Specifically, the hydraulic pump 20 has a first port 21 and a second port 22 each of which serves as both a discharge port and a suction port. The first port 21 is connected to the rod side chamber 17 of the hydraulic cylinder 10 via a first pipe 5 and the second port 22 is connected to the head side chamber 18 of the hydraulic cylinder 10 via a second pipe 6.

The rotational direction of the hydraulic pump 20 is switchable between a first direction for discharging hydraulic fluid through the first port 21 and sucking the hydraulic fluid through the second port 22 and a second direction for discharging the hydraulic fluid through the second port 22 and sucking the hydraulic fluid through the first port 21. The first direction is a rotational direction for contracting the hydraulic cylinder 10 to move the load 2 in the lowering direction, while the second direction is a rotational direction for extending the hydraulic cylinder 10 to move the load 2 in the raising direction.

To the closed circuit 4 are connected first and second relief valves 7, 8. The first relief valve 7 is interposed between the first pipe 5 and a tank, configured to be opened when a pressure in the first pipe 5 is equal to or higher than a set pressure. Similarly, the second relief valve 8 is interposed between the second pipe 6 and the tank, configured to be opened when the pressure in the second pipe 6 becomes equal to or higher than a set pressure.

The auxiliary hydraulic pump 24 is configured with, for example, a variable displacement type hydraulic pump. The auxiliary hydraulic pump 24 is connected to the second pipe 6 via a backflow preventing check-valve 23 to feed supplemental hydraulic fluid to the second pipe 6 by an amount corresponding to a difference in area between the rod side chamber 17 and the head side chamber 18 when the hydraulic cylinder 10 is extended, i.e., when a raising drive which is a drive in the raising direction is performed. The area of the rod side chamber 17 is smaller than the area of the head side chamber 18 by the area of the rod 16. Hence, to extend the hydraulic cylinder 10 while maintaining excellent circulation of the hydraulic fluid in the closed circuit 4, the amount of hydraulic fluid to be supplied from the hydraulic pump 20 to the head side chamber 18 of the hydraulic cylinder 10 has to be greater than the amount of hydraulic fluid to be returned from the rod side chamber 17 of the hydraulic cylinder 10 to the hydraulic pump 20 by an amount corresponding to the area difference. The auxiliary hydraulic pump 24 is driven by the drive source 26 during the raising drive to feed supplemental hydraulic fluid to the second pipe 6.

The auxiliary hydraulic pump 24 is not absolutely required in the present invention. For example, in the case where the hydraulic actuator connected to a load is a hydraulic motor, the auxiliary hydraulic pump 24 can be omitted.

The drive source 26 generates motive power for driving both the hydraulic pump 20 and the auxiliary hydraulic pump 24. Specifically, the drive source 26 has an output shaft, which is connected to respective input shafts of the hydraulic pumps 20, 24. The drive source 26 may be either an engine which receives a supply of a fuel to generate motive power or an electric motor which receives a supply of electric power to be operated. In the latter case, the discharge flow rate of the hydraulic pump 20 can be controlled by regulation of the rotational speed of the electric motor, which eliminates the necessity that the hydraulic pump 20 be of a variable displacement type. In other words, this case permits the hydraulic pump 20 to be of a fixed displacement type.

The charge circuit 30 is configured to feed supplemental hydraulic fluid to the closed circuit when a pressure in the closed circuit 4 becomes lower than a predetermined set pressure. Specifically, when a pressure of hydraulic fluid in any of the first and second pipes 5, 6 becomes lower than the set pressure, the charge circuit 30 performs the supplemental feed of hydraulic fluid to the pipe. The charge circuit 30 includes, as means for the supplemental feed of hydraulic fluid, a charge pump 32, a charge pipe 34, first and second check-valves 35, 36, and a relief valve 38.

The charge pump 32 is formed of a hydraulic pump, configured to receive a supply of motive power from the drive source 26 to discharge hydraulic fluid and supplies the hydraulic fluid to the first pipe 5 or the second pipe 6 through the charge pipe 34, similarly to the hydraulic pumps 20, 24. The charge pipe 34 branches halfway so as to connect a discharge port of the charge pump 32 with the first and second pipes 5, 6. The first and second check-valves 35, 36 are disposed at respective parts of the charge pipe 34 branching to the first pipe 5 and the second pipe 6 to prevent a back flow from the first and second pipes 5, 6 to the charge pump 32.

The relief valve 38 is operable to allow hydraulic fluid to be supplied, only when a pressure of the hydraulic fluid in either the first or second pipe 5 or 6 becomes equal to or lower than the set pressure from the charge pump 32, to the pipe in which the pressure of the hydraulic fluid is equal to or lower than the set pressure. Specifically, the relief valve 38 is interposed between the charge pipe 34 and the tank, configured to be opened, when the primary pressure of the relief valve 38 is equal to or greater than the set pressure, to let the hydraulic fluid discharged from the charge pump 32 escape to the tank and thereby inhibit supplemental hydraulic fluid from being to be fed to the closed circuit 4. Besides, the relief valve 38 is configured to be closed, when the primary pressure becomes lower than the set pressure, to allow supplemental hydraulic fluid to be fed to the first pipe 5 or the second pipe 6.

The regeneration circuit 40 is a circuit for regenerating potential energy and/or kinetic energy possessed by the load 2 during the lowering drive in which the hydraulic cylinder 10 is operated so as to actuate the load 2 in the lowering direction and for controlling a speed of the load 2 in the lowering direction. Specifically, the regeneration circuit 40 includes an accumulator 42, an accumulation valve 44, a regeneration motor 46, and a regeneration selector valve 48.

The accumulator 42 is connected to the second pipe 6 via the accumulation valve 44 so as to receive and accumulate a part of the hydraulic fluid discharged from the head side chamber 18 of the hydraulic cylinder 10 to the second pipe 6 during the lowering drive.

The accumulation valve 44, which is interposed between the second pipe 6 and the accumulator 42 in order to regulate a flow rate of the hydraulic fluid from the second pipe 6 to the accumulator 42, corresponds to an accumulator-flow-rate regulator according to the present invention. The accumulation valve 44 according to this embodiment is a pilot-controlled selector valve having a pilot port 44*a*, configured to be opened at an opening degree corresponding to a pilot pressure input to the pilot port 44*a* and to thereby allow hydraulic fluid to be flowed from the second pipe 6 into the accumulator 42 at a flow rate corresponding to the opening degree. The pilot port 44*a* is connected to a pilot hydraulic source not shown via an electromagnetic proportional control valve 45. The electromagnetic proportional control valve 45 is opened at an opening degree corresponding to a flow rate command signal input from the controller 60 to thereby change the magnitude of the pilot pressure to be input from the pilot hydraulic source to the pilot port 44*a*. Between the accumulation valve 44 and the second pipe 6 is interposed a check-valve 41 which prevents hydraulic fluid from a back flow from the accumulator 42 to the second pipe 6.

The regeneration motor 46, which is a regeneration actuator driven by energy of the hydraulic fluid accumulated in the accumulator 42 to thereby convert the energy into motive power, is connected to the accumulator 42 in parallel to the accumulation valve 44. The regeneration motor 46 is, specifically, disposed halfway in a pipe leading from the accumulator 42 to the tank so as to bypass to the accumulation valve 44. The regeneration motor 46 is rotationally driven by energy of hydraulic fluid supplied from the accumulator 42 and discharges the hydraulic fluid to the tank. Furthermore, this embodiment involves connection of the regeneration motor 46 to the drive source 26 together with the hydraulic pumps 20, 24, thereby allowing the drive source 26 to be assisted in driving the hydraulic pumps 20, 24, by utilization of the motive power generated by the regeneration motor 46.

The regeneration selector valve 48 is interposed between the accumulator 42 and the regeneration motor 46 and is switchable between a position for allowing hydraulic fluid to be supplied from the accumulator 42 to the regeneration motor 46 and a position for cutting off the supply. The regeneration selector valve 48 according to this embodiment is a selector valve having a pilot port 48*a*, being configured to be opened at an opening degree corresponding to a pilot pressure input to the pilot port 48*a* to allow hydraulic fluid to be supplied from the accumulator 42 to the regeneration motor 46 at a flow rate corresponding to the opening degree. The pilot port 48*a* is connected to the pilot hydraulic source via an electromagnetic proportional control valve 49. The electromagnetic proportional control valve 49 is opened at an opening degree corresponding to a regeneration command signal input from the controller 60 to thereby change the magnitude of the pilot pressure to be input from the pilot hydraulic source to the pilot port 48*a*. Between the regeneration selector valve 48 and the regeneration motor 46 is provided a check-valve 47 which prevents hydraulic fluid from a back flow from the regeneration motor 46 to the accumulator 42.

The regeneration selector valve 48 may be a simple selector valve having no flow-rate regulation capability differently from the above-described one, for example, may be a solenoid operated selector valve. In the case where the regeneration motor 46 is a variable displacement type hydraulic motor as shown in FIG. 1, the drive speed of the regeneration motor 46 can be controlled not only by flow regulation by the regeneration selector valve 48 but also by adjusting the displacement volume of the regeneration motor 46.

Each of the pressure sensors 51, 52, 53 senses a pressure of hydraulic fluid at the position where the sensor is provided, and converts the same into a pressure detection signal as an electric signal. Specifically, the pressure sensor 51 detects a pressure P1 of hydraulic fluid in the first pipe 5, and the pressure sensor 52 detects a pressure P2 of hydraulic fluid in the second pipe 6. The pressure P2 in the second pipe 6 corresponds to a "discharge pressure" which is a pressure of hydraulic fluid discharged from the head side chamber 18 of the hydraulic cylinder 10 during the lowering drive. The pressure sensor 52 therefore corresponds to a "discharge pressure detector". The pressure sensor 53 detects a pressure Pa of hydraulic fluid to be introduced into the accumulator 42, the pressure Pa corresponding to an "accumulator pressure". The pressure sensor 53 therefore corresponds to "the accumulator pressure detector" in the present invention.

The manipulation device 56 includes an operation member 57, for example, a control lever, being configured to generate a manipulative signal which is an electric signal corresponding to an operational direction and an operational amount on the operation member 57. The operational direction on the operation member 57 designates a rotational direction of the hydraulic pump 20, i.e., an actuating direction of the hydraulic cylinder 10, and the operational amount on the operation member 57 designates an actuating speed of the hydraulic cylinder 10. In this embodiment, the speed designated by the operation applied to the operation member 57 is regarded as a target speed of the hydraulic cylinder 10.

Both of the pressure detection signal generated by each of the pressure sensors 51, 52, 53 and the manipulative signal generated by the manipulation device 56 are input to the controller 60. The controller 60, which is formed of, for example, a microcomputer, performs various kinds of controls based on respective inputs of the pressure detection signal and the manipulative signal.

Figure 2:
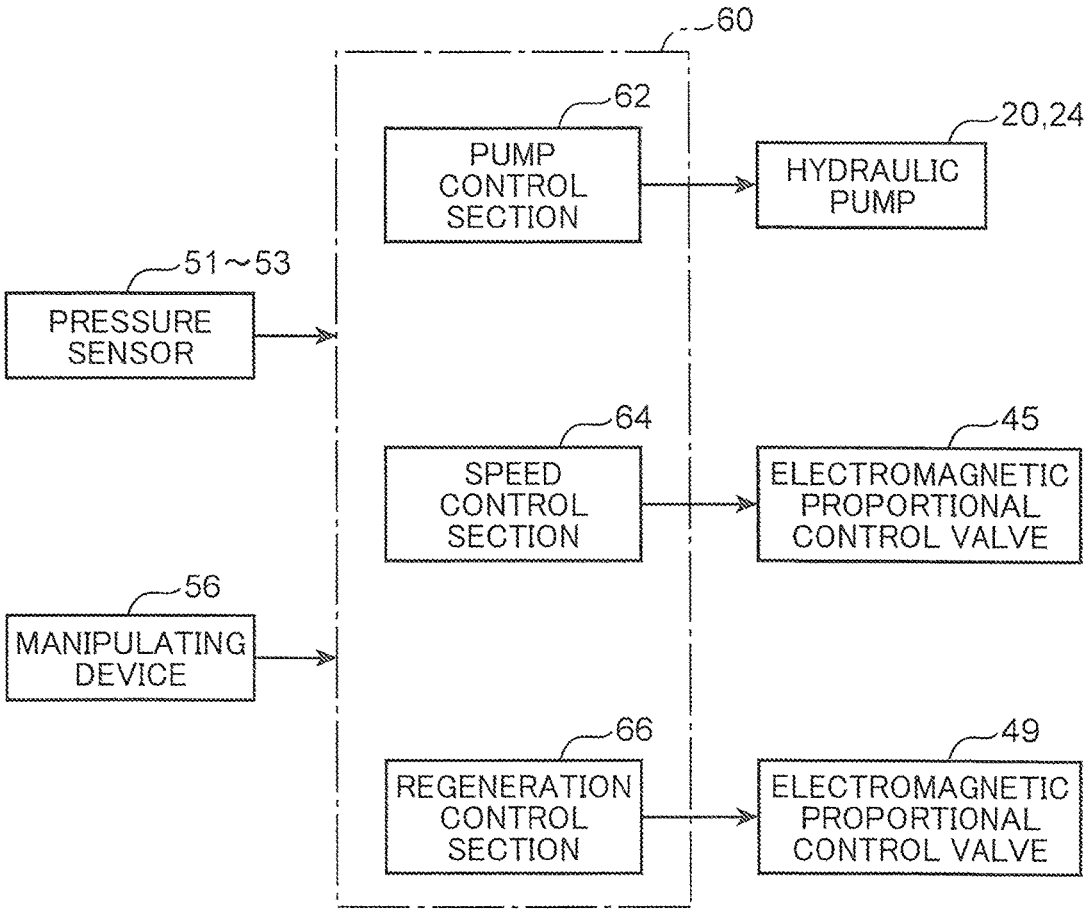
FIG. 2 is a block diagram showing a functional configuration of a controller in the hydraulic drive apparatus according to the first embodiment.

Specifically, the controller 60 according to this embodiment has main functions, namely, a pump control section 62, a speed control section 64 and a regeneration control section 66, as shown in FIG. 2.

The pump control section 62 changes the displacement volume of each of the hydraulic pumps 20, 24 according to an operational state of the apparatus. Specifically, the pump control section 62 outputs a displacement command signal with respect to a regulator provided in each of the hydraulic pumps 20, 24 to change the tilt angle of each of the hydraulic pumps 20, 24. The pump control section 62 determines a rotational direction and a displacement volume of the hydraulic pump 20, based on the manipulative signal input from the manipulation device 56, to issue to the hydraulic pump 20 an instruction for the tilt angle of the hydraulic pump 20 corresponding to the rotational direction and the displacement volume.

To perform effective regeneration during the lowering drive, the pump control section 62 further includes a function of limiting the discharge flow rate of the hydraulic pump 20 during the lowering drive to a predetermined regeneration flow rate. The pump control section 62 specifically has a function of lowering the displacement volume of the hydraulic pump 20 to a predetermined regeneration displacement volume qp. For example, the regeneration displacement volume qp is preferably the minimum displacement volume of the hydraulic pump 20 or a displacement volume close to the same. In the case where the hydraulic pump 20 is a fixed displacement type hydraulic pump and the drive source 26 is an electric motor, the pump control section 62 may perform control of limiting the rotational speed of the electric motor to a predetermined regenerative rotational speed during the lowering drive.

The speed control section 64 is configured to cause the accumulation valve 44 to be closed during the raising drive to inhibit hydraulic fluid from being flowed into the accumulator 42 from the second pipe. In contrast, during the lowering drive, the speed control section 64 causes the accumulation valve 44 to be opened and adjust an opening degree of the accumulation valve 44 so as to bring the actuating speed of the hydraulic cylinder 10, i.e., a contractuating speed thereof, close to a target speed. The target speed in this embodiment is a speed designated by the operation applied to the operation member 57 of the manipulation device 56 as described above, but it may be other speed, for example, a predetermined speed. The speed control section 64, specifically, inputs the flow rate command signal to the electromagnetic proportional control valve 45 connected to the accumulation valve 44, causing the electromagnetic proportional control valve 45 to input, to the accumulation valve 44, a pilot pressure corresponding to the flow rate command signal. The speed control section 64 thus regulates a flow rate of the hydraulic fluid in the accumulation valve 44, i.e., a flow rate of the hydraulic fluid flowed into the accumulator 42 from the second pipe 6. The specific method of controlling the contractuating speed of the hydraulic cylinder 10 will be described in detail later.

The regeneration control section 66 performs control of supply of the hydraulic fluid from the accumulator 42 to the regeneration motor 46, i.e., control of regenerating operation of converting the energy of the hydraulic fluid accumulated in the accumulator 42 into motive power, by opening and closing operation of the regeneration selector valve 48. Specifically, the regeneration control section 66 inputs a regeneration command signal to the electromagnetic proportional control valve 49 connected to the regeneration selector valve 48, causing the electromagnetic proportional control valve 49 to input, to the regeneration selector valve 48, a pilot pressure corresponding to the regeneration command signal. The regeneration control section 66 thus regulates a flow rate of the hydraulic fluid in the regeneration selector valve 48, i.e., a flow rate of the hydraulic fluid supplied from the accumulator 42 to the regeneration motor 46.

Figure 3:
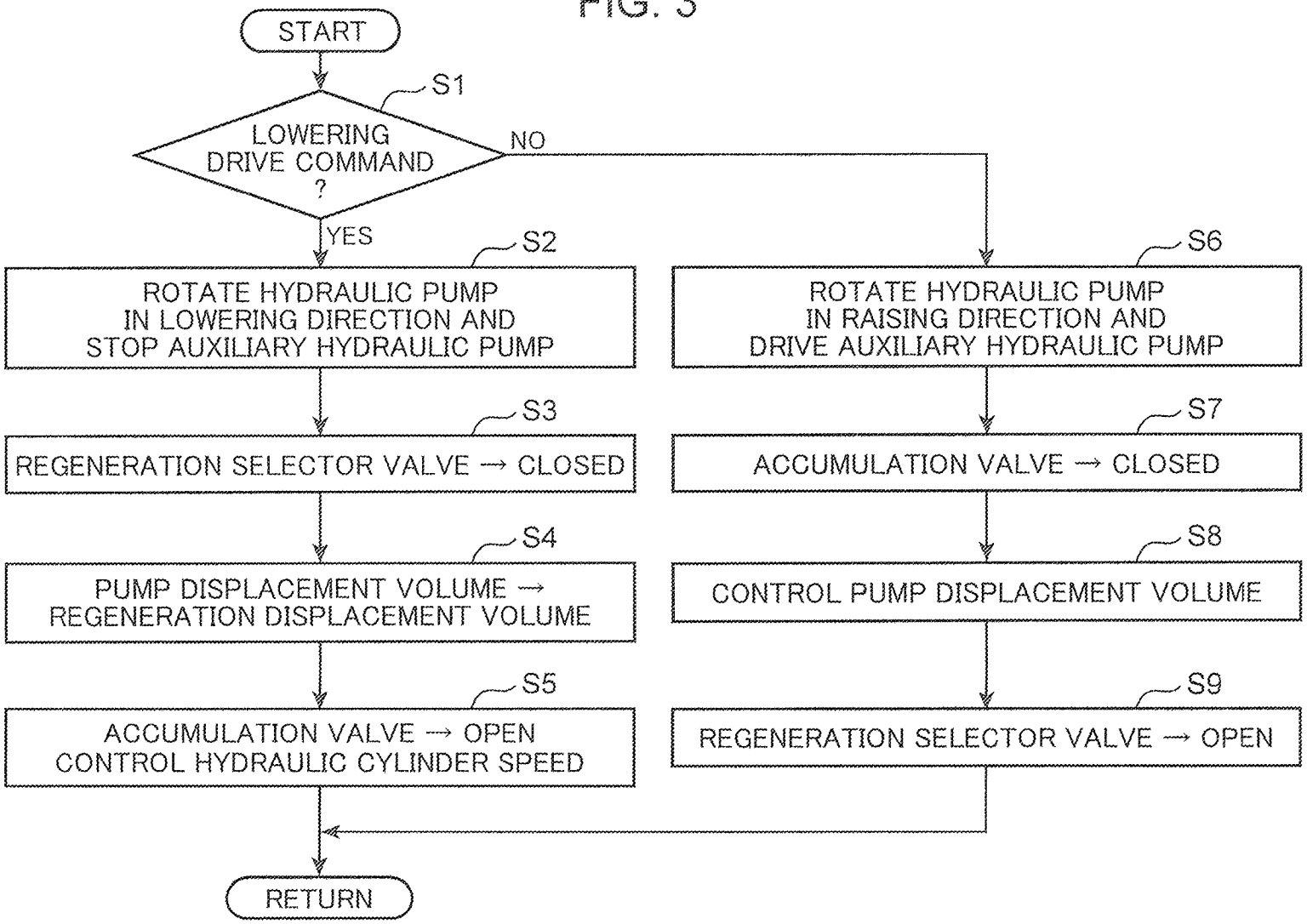
FIG. 3 is a flow chart showing computation and control carried out by the controller according to the first embodiment.

Next will be described computation and control actually carried out by the controller 60 and an accompanying action of the apparatus with reference to the flow chart of FIG. 3.

First, when the operation member 57 of the manipulation device 56 is operated so as to issue a command for actuating the load 2 in the lowering direction (YES at Step S1), the pump control section 62 stops the auxiliary hydraulic pump 24 while inputting a command signal to the regulator of the hydraulic pump 20 to rotate the hydraulic pump 20 in a direction corresponding the lowering direction, namely, the first direction (Step S2). The first direction is, in other words, the rotational direction for bringing the hydraulic cylinder 10 into a motion in a contracting direction. Specifically, the first direction is a direction for supplying hydraulic fluid from the first port 21 of the hydraulic pump 20 to the rod side chamber 17 of the hydraulic cylinder 10 via the first pipe 5 and returning the hydraulic fluid in the head side chamber 18 of the hydraulic cylinder 10 to the second port 22 of the hydraulic pump 20 through the second pipe 6.

The motion of the hydraulic cylinder 10 in the contracting direction that is a lowering direction including a component of a direction in which gravity acts on the load 2 increases the pressure in the head side chamber 18 by the gravity acting on the load 2 while decreasing the pressure in the rod side chamber 17. This causes a high-pressure hydraulic fluid to be discharged from the head side chamber 18.

During the lowering drive, the regeneration control section 66 causes the regeneration selector valve 48 to be closed to cut off the supply of hydraulic fluid from the accumulator 42 to the regeneration motor 46 (Step S3), and the pump control section 62 reduces the displacement volume of the hydraulic pump 20 to the regeneration displacement volume qp in order to make regeneration possible (Step S4). On the other hand, the speed control section 64 causes the accumulation valve 44 to be opened to allow hydraulic fluid to be flowed into the accumulator 42 from the second pipe 6, i.e., to allow the accumulator 42 to accumulate pressure, and regulates the flow rate of the hydraulic fluid flowed thereinto. The speed control section 64 thus carries out the control to bring the actuating speed of the hydraulic cylinder 10 in the lowering direction, i.e., the contractuating speed V, close to the target speed Vr designated by the operation applied to the operation member 57 (Step S5).

As a specific method for the control, the speed control section 64 changes the opening degree of the accumulation valve 44 as an accumulator-flow-rate regulator so as to bring the accumulator introduction flow rate Qa close to a target introduction flow rate Qar. The accumulator introduction flow rate Qa is a flow rate of the hydraulic fluid obtained from a difference between the pressure P2 of the discharged hydraulic fluid, namely, a discharge pressure detected by the pressure sensor 52 (that is, a pressure in the second pipe 6) and the accumulator pressure Pa detected by the pressure sensor 53, i.e., a flow rate of the hydraulic fluid introduced from the hydraulic cylinder 10 to the accumulator 42. The target introduction flow rate Qar is a difference between a target discharge flow rate Qhr that is a flow rate of the discharged hydraulic fluid corresponding to the target speed Vr and a pump absorption flow rate Qp corresponding to the regeneration displacement volume qp of the hydraulic pump 20, i.e., Qar=Qhr−Qp. The speed control section 64 is thus allowed to perform speed control of the hydraulic cylinder 10 during the lowering drive based on simple information on the discharge pressure P2 and the accumulator pressure Pa.

The principle of the control is as follows. Assuming now the area of the head side chamber 18 in the hydraulic cylinder 10 to be Ah, the target discharge flow rate Qhr as a flow rate of the hydraulic fluid discharged from the head side chamber 18 corresponding to the target speed Vr can be expressed as Qhr=Ah×Vr. On the other hand, assuming the number of revolution of the hydraulic pump 20 to be Np, the absorption flow rate Qp of the hydraulic pump 20 corresponding to the regeneration displacement volume qp is expressed as Qp=qp×Np. Therefore, determining the regeneration displacement volume qp so as to establish Qh>Qp=qp×Np enables energy to be regenerated during the lowering drive to be performed.

In this case, the relationship between the actual flow rate Qh of discharged hydraulic fluid (the hydraulic fluid discharged through the head side chamber 18 of the hydraulic cylinder 10) and the accumulator introduction flow rate Qa that is a flow rate of the hydraulic fluid flowing through the accumulation valve 44, i.e., a flow rate of the hydraulic fluid flowed from the second pipe 6 into the accumulator 42, is expressed as Qa=Qh−Qp. Therefore, regulating the accumulator introduction flow rate Qa so as to bring the flow rate Qa in the accumulation valve 44 close to the target introduction flow rate Qar=Qhr−Qp enables the actual actuating speed of the hydraulic cylinder 10 to be close to the target speed Vr, thus the speed control being executed.

On the other hand, the flow rate Qa in the accumulation valve 44 is obtained from the discharge pressure P2 detected by the pressure sensor 52 (that is, the pressure in the second pipe 6) and the accumulator pressure Pa detected by the pressure sensor 53, based on the following expression, wherein an opening area of the accumulation valve 44 represented as Ar and a flow rate coefficient as Cv.

$$Qa=Ar\times Cv\times\sqrt{(P2-Pa)} \quad (1)$$

Thus, the accumulator introduction flow rate Qa can be obtained from the discharge pressure P2 and the accumulator pressure Pa based on the above Expression (1). By feedback control of operating the opening area Ar so as to bring the accumulator introduction flow rate Qa close to the target introducing flow rate Qarm (i.e., inputting the flow rate command signal to the electromagnetic proportional control valve 45), the speed control section 64 can appropriately control the actuating speed of the hydraulic cylinder 10 in the lowering direction. Alternatively, the speed control section 64 is allowed to appropriately control the actuating speed of the hydraulic cylinder 10 in the lowering direction by operating the opening area Ar based on the discharge pressure P2 and the accumulator pressure Pa so as to satisfy the following Expression (2) derived from Expression (1).

$$Ar=Qar/[Cv\times\sqrt{(P2-Pa)}] \quad (2)$$

In contrast, when the operation member 57 of the manipulation device 56 is operated so as to issue an instruction to drive the load 2 to the raising direction (NO at Step S1), the pump control section 62 inputs respective command signals for activating the auxiliary hydraulic pump 24 and rotating the hydraulic pump 20 in the second direction corresponding the raising direction (Step S6). The second direction is, in other words, a rotational direction for bringing the hydraulic cylinder 10 into motion in an extending direction. Specifically, the second direction is a direction for supplying hydraulic fluid from the second port 22 of the hydraulic pump 20 to the head side chamber 18 of the hydraulic cylinder 10 through the second pipe 6 and returning hydraulic fluid in the rod side chamber 17 of the hydraulic cylinder 10 to the first port 21 of the hydraulic pump 20 through the first pipe 5.

For thus operating the hydraulic cylinder 10 in an extending direction which is the raising direction opposite to gravity acting on the load 2, drive of the hydraulic cylinder 10 requires great motive power. Besides, for supplemental feed of the hydraulic fluid corresponding to a difference in area between the rod side chamber 17 and the head side chamber 18 to the second pipe 6, operation of the auxiliary hydraulic pump 24 is required.

During the raising drive, the speed control section 64 causes the accumulation valve 44 to be closed to inhibit hydraulic fluid from being flowed into the accumulator 42 from the second pipe 6 (Step S7), while the pump control section 62 controls the displacement volume of the hydraulic pump 20 according to an operational state (Step S8).

Besides, the regeneration control section 66 causes the regeneration selector valve 48 to be opened to allow hydraulic fluid to be supplied from the accumulator 42 to the regeneration motor 46 (Step S9). The regeneration motor 46 thereby converts the energy of the hydraulic fluid into motive power and assists the drive source 26 in driving the hydraulic pumps 20, 24 by utilization of the motive power. This allows motive power necessary for driving the hydraulic cylinder 10 in the raising direction to be secured and allows an effective utilization of the energy recovered during the lowering drive to be achieved.

In the present invention, the utilization of motive power generated by the regeneration actuator is not limited to driving the hydraulic pumps 20, 24. For example, the regeneration motor 46 according to the first embodiment may be connected to a drive source different from the drive source 26. Alternatively, in the case where the drive source 26 is connected to a hydraulic device different from the hydraulic pumps 20, 24 to drive the hydraulic device, the regenerative motive power can be used for assisting the drive source 26 in driving the hydraulic apparatus. In this case, it is preferable that the regeneration control section 66 causes the regeneration selector valve 48 to be opened so as to allow hydraulic fluid to be supplied from the accumulator 42 to the regeneration motor 46 when driving force for the different hydraulic device is required.

Figure 4:
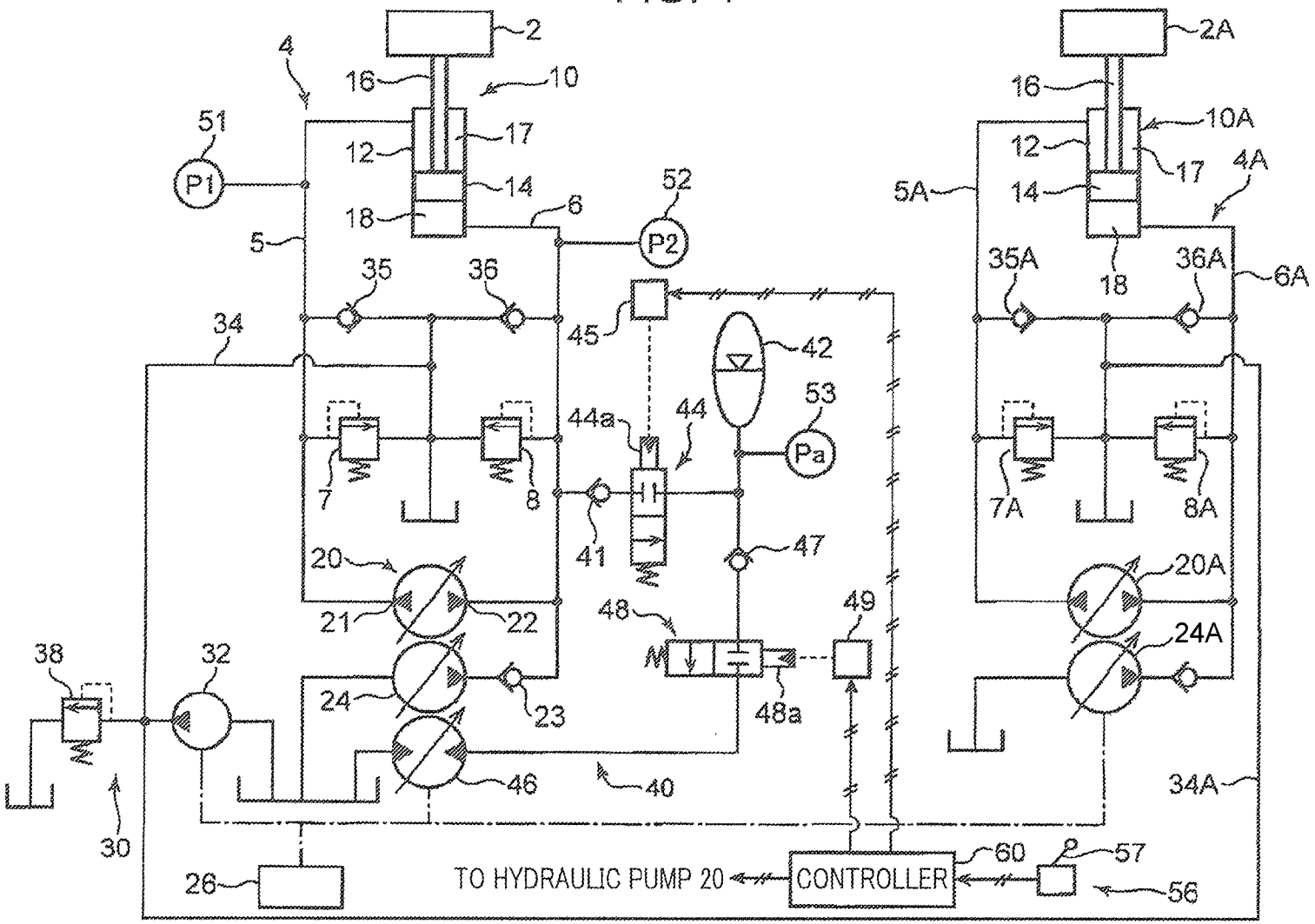
FIG. 4 is a circuit diagram showing a hydraulic drive apparatus according to a second embodiment of the present invention.

An example thereon is shown in FIG. 4 as a second embodiment. The apparatus according to the second embodiment includes all the components of the apparatus according to the first embodiment device, while a drive source 26 is connected, in addition to hydraulic pumps 20, 24, to another hydraulic pump 20A and auxiliary hydraulic pump 24A for driving another hydraulic cylinder 10A.

As shown in FIG. 4, the hydraulic cylinder 10A has a cylinder body 12, a piston 14, and a rod 16, similarly to the hydraulic cylinder 10 of the closed circuit 4. The rod 16 is disposed so as to be directed upward, having a distal end to which a load 2A is connected. The hydraulic cylinder 10A is, therefore, capable of extending to raise the load 2A against a self-weight of the load 2A (a raising drive state) and contracting to lower the load 2A in a direction of the self-weight of the load 2A (a lowering drive state).

Similarly to the hydraulic pump 20, the hydraulic pump 20A is connected to the hydraulic cylinder 10A so as to configure a closed circuit 4A together with the hydraulic cylinder 10A. The auxiliary hydraulic pump 24A feeds supplemental hydraulic fluid to the closed circuit 4A when the hydraulic cylinder 10A extends. Specifically, similarly to the closed circuit 4, the closed circuit 4A includes a first pipe 5A, a second pipe 6A, and first and second relief valves 7A, 8A, which correspond to a first pipe 5, a second pipe 6, and first and second relief valves 7, 8, respectively. Besides, a charge circuit 30 includes a charge pipe 34A branching halfway to connect a discharge port of a charge pump 32 with the first and second pipes 5A, 6A, and first and second check-valves 35A, 36A provided at respective parts of the charge pipe 34A branching to the first pipe 5A and the second pipe 6A, respectively.

In the second embodiment, a regeneration control section of a controller 60 preferably causes a regeneration selector valve 48 to be opened so as to allow hydraulic fluid to be supplied to a regeneration motor 46 from an accumulator 42 during raising drive of the hydraulic cylinder 10A which requires high motive power for driving the hydraulic pump 20A, in addition to a time of a raising drive of the hydraulic cylinder 10. This enables a long time to be spend for an operation of the regeneration motor 46, i.e., for converting energy accumulated in the accumulator 42 into motive power, thereby making it possible to fully spend the energy accumulated in the accumulator 42 with use of a relatively small type of the regeneration motor 46.

Figure 5:
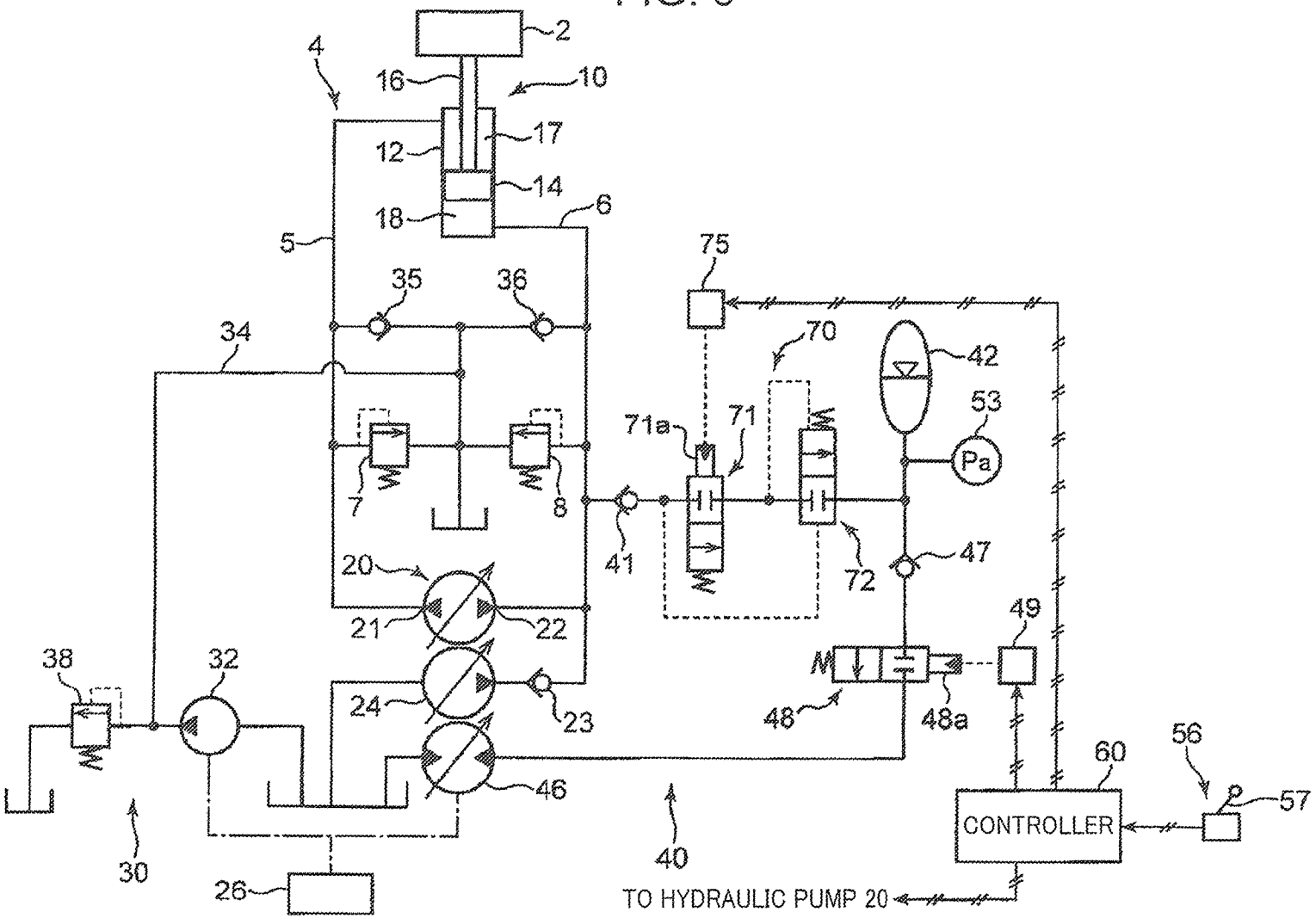
FIG. 5 is a circuit diagram showing a hydraulic drive apparatus according to a third embodiment of the present invention.

An accumulator-flow-rate regulator according to the present invention may have a flow regulation capability itself, for example, may be capable of performing self-control so as to realize a flow rate designated by a speed control section 64 of the controller 60. An example thereon is shown as a third embodiment in FIG. 5.

The apparatus shown therein includes an accumulator-flow-rate regulator 70 in place of the accumulation valve 44 of the apparatus shown in FIG. 1. The accumulator-flow-rate regulator 70 includes a variable aperture restrictor 71 and a flow rate regulation valve 72.

The variable aperture restrictor 71 is configured with a hydraulic pilot type flow control valve having a pilot port 71*a* and is configured to make opening and closing action so as to realize an opening area corresponding to a pilot pressure to be input to the pilot port 71*a*. To the pilot port 71*a* is connected a pilot hydraulic source not shown via an electromagnetic proportional control valve 75. A speed control section 64 of a controller 60 inputs a flow rate command signal to the electromagnetic proportional control valve 75 to thereby cause a pilot pressure corresponding to the flow rate command signal to be input to the pilot port 71*a*.

The flow rate regulation valve 72 makes opening and closing action so as to keep a cross differential pressure, which is a difference between an upstream side pressure and a downstream side pressure across the variable aperture restrictor 71, i.e., a differential pressure corresponding to a flow rate of the hydraulic fluid flowing through the variable aperture restrictor 71, be a fixed set differential pressure. Specifically, the flow rate regulation valve 72 includes a pair of pilot ports disposed at opposite positions, respectively, and the upstream side pressure and the downstream side pressure across the variable aperture restrictor 71 are input to the pilot ports as respective pilot pressures, thus opening the flow rate regulation valve 72 at an opening degree corresponding to the difference between the pressures. The opening degree of the flow rate regulation valve 72 is, therefore, determined by the opening degree of the variable aperture restrictor 71 and the flow rate of the hydraulic fluid in the variable aperture restrictor 71.

According to this accumulator-flow-rate regulator 70, the opening degree of the flow rate regulation valve 72 is automatically regulated so as to adjust the cross differential pressure across the variable aperture restrictor 71 to the given differential pressure, the cross differential pressure being varied in accordance with the opening degree of the variable aperture restrictor 71 and the flow rate of hydraulic fluid in the variable aperture restrictor. This enables the speed control section 64 of the controller 60 to perform control of bringing the flow rate of the discharged hydraulic fluid of the hydraulic cylinder 10 close to a target discharge flow rate Qhr corresponding to a target speed Vr by simple operation of only inputting a flow rate command signal corresponding to a target introducing flow rate Qar (=Qhr−Qp) to the electromagnetic proportional control valve 75. This eliminates the necessity for the pressure sensors 52, 53 shown in FIG. 1, namely, a discharge pressure detector and the accumulator pressure detector.

The speed control section according to the present invention, alternatively, may exercise a direct detection of the flow rate of discharged hydraulic fluid and operate the accumulator-flow-rate regulator so as to bring the detected flow rate close to the into motion flow rate corresponding to the target speed Vr. In summary, the speed control section according to the present invention may be configured to change an accumulator flow rate in the accumulator-flow-rate regulator.

In the present invention, the place to which the hydraulic fluid discharged from the hydraulic actuator during the lowering drive is let escape is not limited to the accumulator. For example, the hydraulic fluid discharged from the hydraulic actuator during the lowering drive may be let escape to both the accumulator and a regenerative hydraulic circuit other than the closed circuit, the regenerative hydraulic circuit including a hydraulic actuator and a hydraulic pump, for example, the closed circuit 4A shown in FIG. 4. Specific example thereon is shown as a fourth embodiment in FIG. 6.

Figure 6:
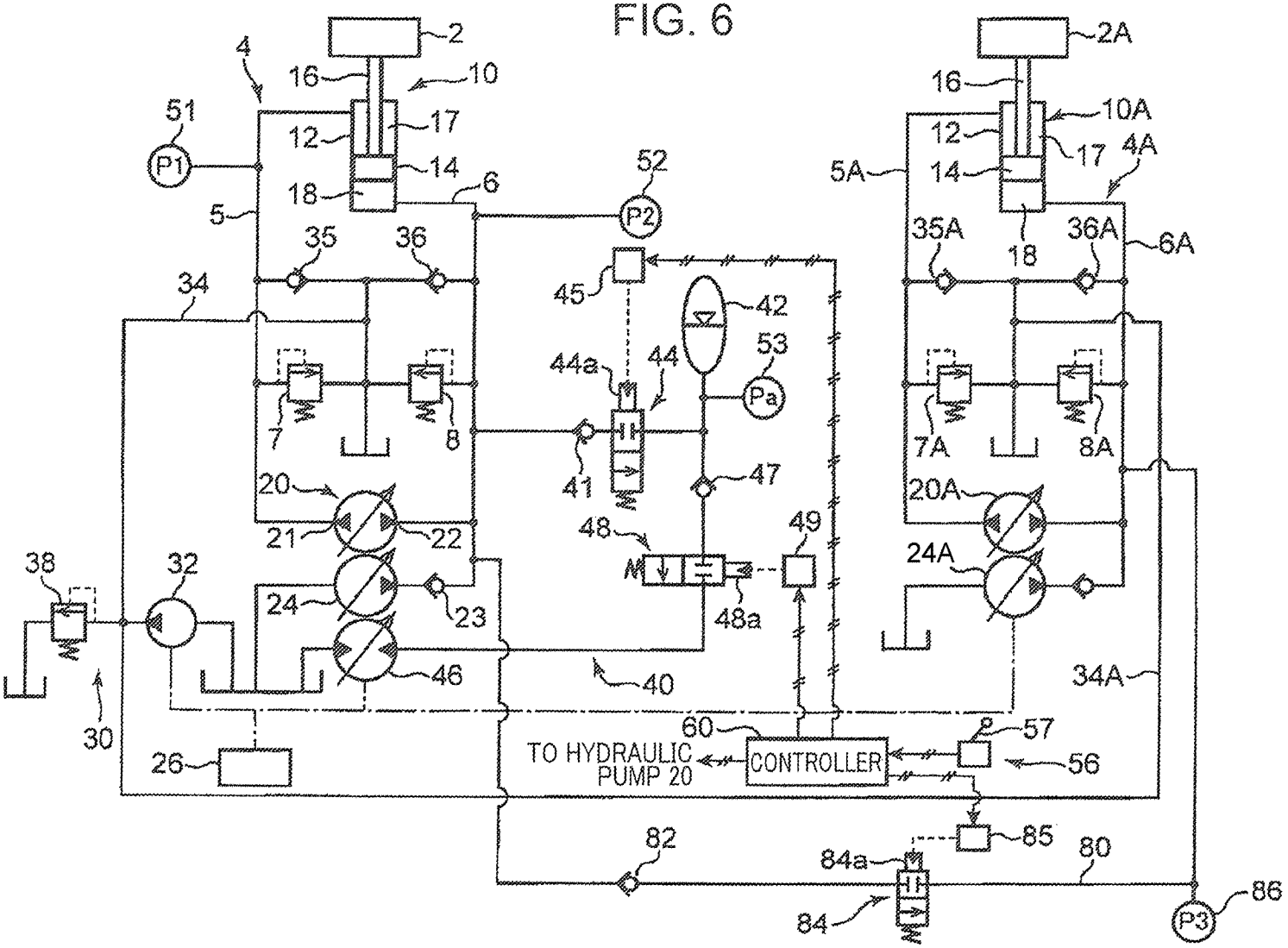
FIG. 6 is a circuit diagram showing a hydraulic drive apparatus according to a fourth embodiment of the present invention.

The apparatus shown in FIG. 6 includes a closed circuit 4A equivalent to a regenerative hydraulic circuit; in the closed circuit 4A, a hydraulic pump 20A and a hydraulic cylinder 10A correspond to a regenerative hydraulic pump and a regenerative hydraulic actuator, respectively. Furthermore, the apparatus includes a regenerative pipe 80, a check-valve 82, a regeneration-flow-rate regulation valve 84, and a pressure sensor 86, in addition to the components of the apparatus shown in FIG. 4.

The regenerative pipe 80 is connected to a second pipe 6 in the closed circuit 4 or a discharge side pipe of an auxiliary hydraulic pump 24 which pipe communicates with the second pipe 6, and connected to a second pipe 6A in the closed circuit 4A, i.e., a pipe for supplying hydraulic fluid from the hydraulic pump 20A to a head side chamber of the hydraulic cylinder 10A during the raising drive, so as to interconnect the second pipe or the discharge side pipe and the second pipe 6A.

The regeneration-flow-rate regulation valve 84, which serves as a regeneration-flow-rate regulator, is provided halfway in the regenerative pipe 80 so as to be interposed between the closed circuit 4 and the closed circuit 4A as a regenerative hydraulic circuit, that is, between the check-valve 82 and the closed circuit 4A in the present embodiment. The regeneration-flow-rate regulation valve 84 according to this embodiment is a pilot operated selector valve having a pilot port 84*a*, configured to be opened at an opening degree corresponding to a pilot pressure input to the pilot port 84*a* and to allow hydraulic fluid to be flowed from the second pipe 6 of the closed circuit 4 into the second pipe 6A of the closed circuit 4A at a flow rate corresponding to the opening degree. The pilot port 84*a* is connected to a pilot hydraulic source via an electromagnetic proportional control valve 85. The electromagnetic proportional control valve 85 is opened at an opening degree corresponding to a regeneration flow rate command signal input from a controller 60 to thereby change the magnitude of the pilot pressure to be input from the pilot hydraulic source to the pilot port 84*a*. The check-valve 82 is interposed between the regeneration-flow-rate regulation valve 84 and the second pipe 6 of the closed circuit 4 to inhibit hydraulic fluid from a back flow from the closed circuit 4A as a regenerative hydraulic circuit to the second pipe 6.

The pressure sensor 86 is disposed at a position where an introduction part pressure P3 which is a pressure in a part of the closed circuit 4A to which hydraulic fluid is introduced through the regenerative pipe 80 can be detected, for example, at a position downstream of the regeneration-flow-rate regulation valve 84 in the regenerative pipe 80 as shown in FIG. 6. The pressure sensor 86 generates a pressure detection signal that is an electric signal corresponding to the introduction part pressure P3 and inputs the same to the controller 60. In cooperation with the pressure sensor 52, the pressure sensor 86 constitutes a pressure detection section that provides information on which pressure is higher, a discharge pressure P2 (that is, a pressure of hydraulic fluid discharged from a head side chamber 18 of the hydraulic cylinder 10 during the lowering drive) or the introduction part pressure P3.

Figure 7:
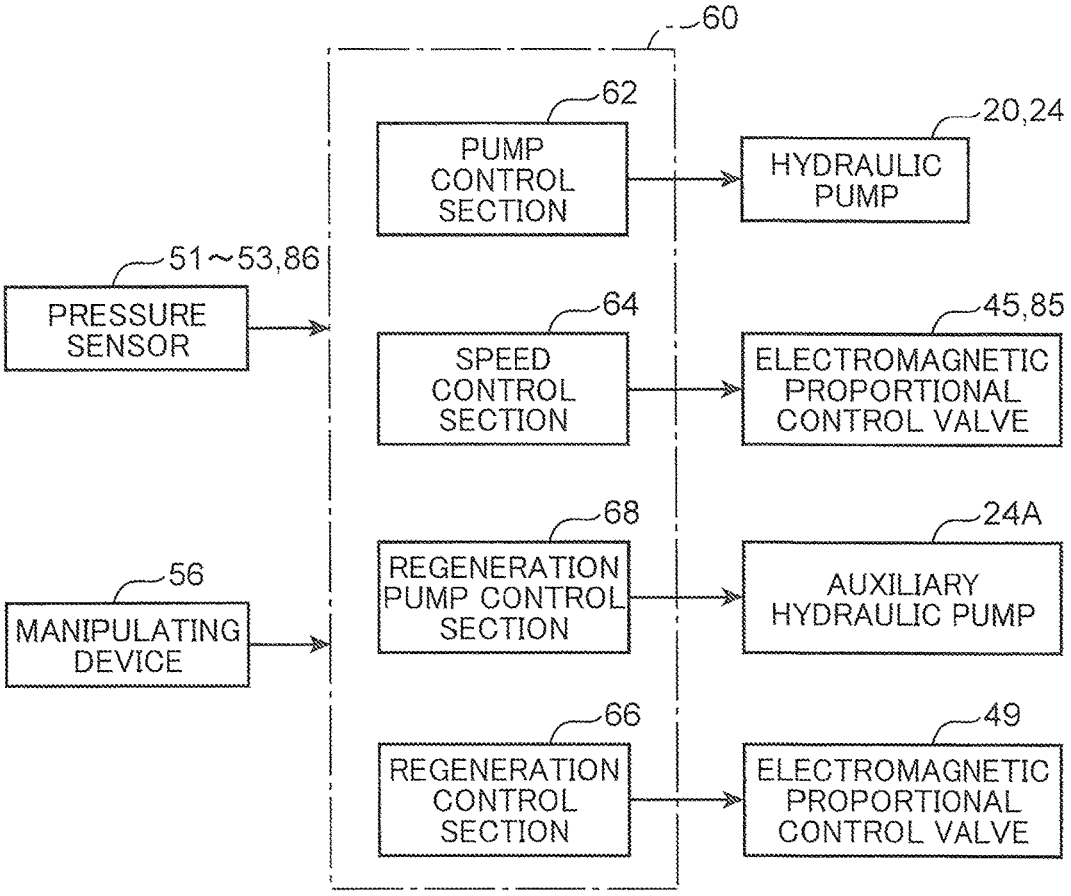
FIG. 7 is a block diagram showing a functional configuration of a controller in the hydraulic drive apparatus according to the fourth embodiment.

On the other hand, the controller 60 shown in FIG. 6 includes a regenerative pump control section 68 shown in FIG. 7 in addition to the pump control section 62, the speed control section 64, and the regeneration control section 66 shown in FIG. 2.

Figure 8:
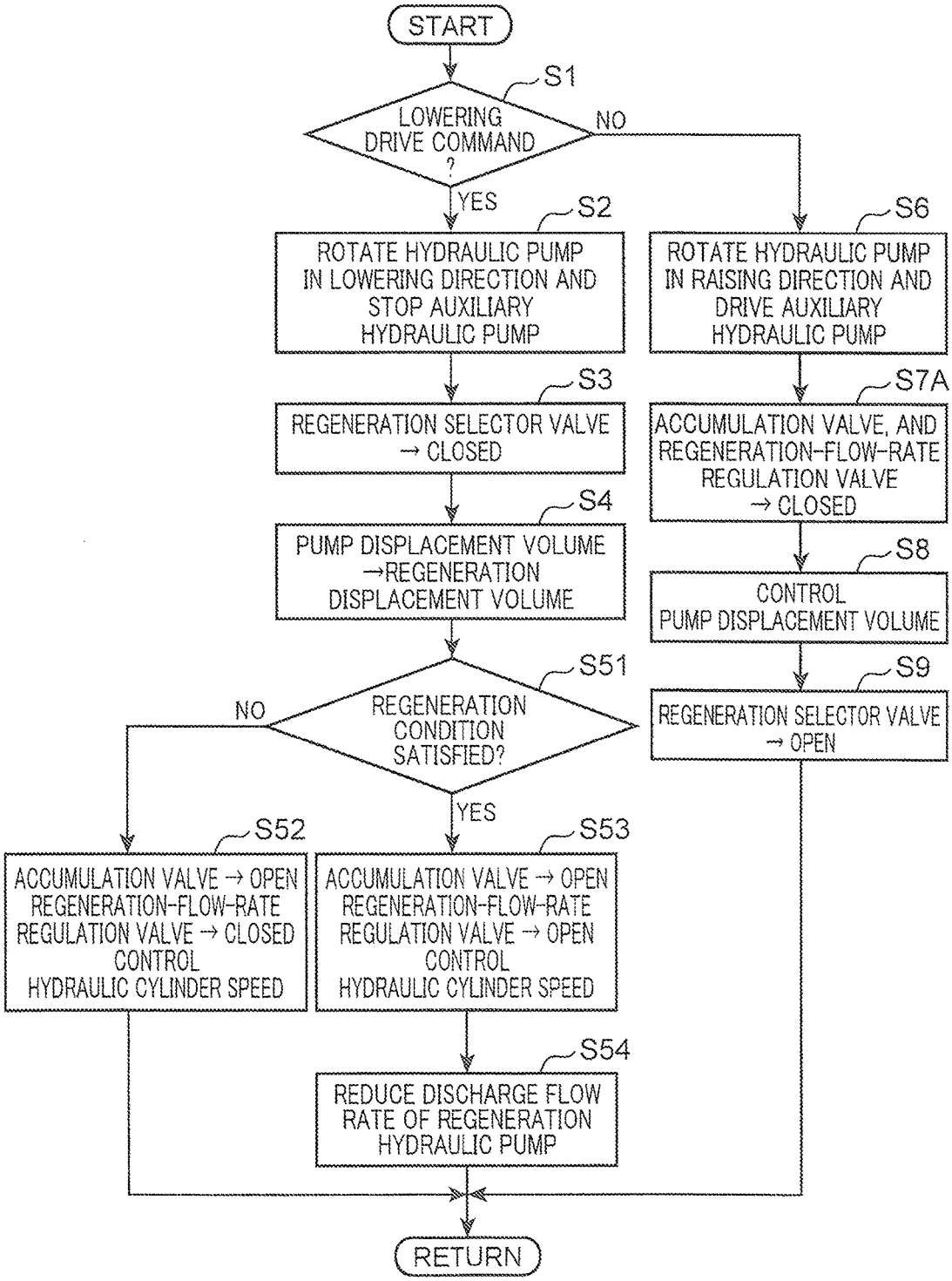
FIG. 8 is a flow chart showing computation and control carried out by the controller according to the fourth embodiment.

As shown in FIG. 6, the speed control section 64 of the controller 60 according to this embodiment is connected to the electromagnetic proportional control valve 85 in addition to the electromagnetic proportional control valve 45. The speed control section 64 controls a regeneration flow rate, i.e., a flow rate of hydraulic fluid supplied to the closed circuit 4A from the closed circuit 4, by operating the regeneration-flow-rate regulation valve 84 to open and close it through the electromagnetic proportional control valve 85. Specifically, during the lowering drive in the closed circuit 4, the speed control section 64 carries out the processes of Steps S51 to S53 shown in FIG. 8 as described below in place of the process of Step S5 shown in FIG. 3.

Step S51: The speed control section 64 judges whether the operational state of the closed circuit 4A as a regenerative hydraulic circuit satisfies a predetermined regeneration condition or not. The regeneration condition according to this embodiment is as follows and regarded as being satisfied when both of the following condition I and condition II are satisfied, I) The closed circuit 4A is in the raising drive state. Specifically, it is required that the closed circuit 4A is in a state where the hydraulic pump 20A supplies hydraulic fluid to the head side chamber of the hydraulic cylinder 10A through the second pipe 6A to thereby extend the hydraulic cylinder 10A to raise a load 2A at a front end of the rod of the cylinder against a self-weight of the load. This condition is set as required, dependently on a specific configuration of the regenerative hydraulic circuit. For example, in the case where the regenerative hydraulic circuit is designed to actuate a load horizontally, it is possible to determine, as a regeneration condition, that the regenerative hydraulic circuit is in the drive state irrespective of a shift direction of the load.

II) The discharged pressure P2 detected by the pressure sensor 52 (that is, the pressure of hydraulic fluid discharged from the head side chamber 18 of the hydraulic cylinder 10 during the lowering drive) is higher than the introduction part pressure P3 detected by the pressure sensor 86. In summary, required here is that hydraulic fluid is allowed to be flowed from the closed circuit 4 to the closed circuit 4A. This condition II can be omitted if the check-valve 82 exists; however, taking the condition II into consideration further ensures prevention of a back flow of the hydraulic fluid from the closed circuit 4A to the closed circuit 4.

Step S52: If the above regeneration condition is not satisfied (NO at Step S51), the speed control section 64 performs speed control equivalent to that of Step S5 shown in FIG. 3. Specifically, the speed control section 64 causes the regeneration-flow-rate regulation valve 84 to be closed to cause only an accumulation valve 44 to be opened, and regulates the opening degree of the accumulation valve 44 so as to bring the actuating speed of the hydraulic cylinder 10 (a contractuating speed in this embodiment) during the lowering drive close to a target speed.

Step S53: If the above regeneration condition is satisfied (YES at Step S51), the speed control section 64 causes the regeneration-flow-rate regulation valve 84, in addition to the accumulation valve 44, to be opened, thus allowing hydraulic fluid to be supplied from the closed circuit 4 to the closed circuit 4A through the regenerative pipe 80. Furthermore, the speed control section 64 regulates respective opening degrees of both the accumulation valve 44 and the regeneration-flow-rate regulation valve 84 so as to bring the actuating speed of the hydraulic cylinder 10 (the contracting speed in this embodiment) during the lowering drive close to the target speed.

Control of the lowering drive speed by regulation of the opening degrees of both the valves 44, 84 can be performed, for example, by fixing an opening degree of one valve and changing only an opening degree of the other valve. However, to suppress the required capacity of an accumulator 42, it is preferable for the speed control section 64 to perform such computation and control as described below.

i) Similarly to the first embodiment, the speed control section 64 calculates a target discharge flow rate Qhr=Ah×Vr based on a target speed Vr of the hydraulic cylinder 10, the target speed Vr being designated, for example, by operation applied to the operation member 57, and a head side area Ah of the hydraulic cylinder 10.

ii) The speed control section 64 determines a target regeneration flow rate Qgr, that is, a target value of a flow rate of hydraulic fluid supplied from the closed circuit 4 to the closed circuit 4A via the regeneration-flow-rate regulation valve 84. The maximum value of the target regeneration flow rate Qgr, namely, the maximum regeneration flow rate Qgmax as the maximum value of the flow rate able to be regenerated, is determined as shown by Expression (3) set forth below. Specifically, the maximum regeneration flow rate Qgmax is determined by selection of the highest value from a maximum allowable flow rate Qvmax of the regeneration-flow-rate regulation valve 84, an actual discharge flow rate Qh from the hydraulic cylinder 10, and a discharge flow rate Qap required of the auxiliary hydraulic pump 24 for the raising drive when a regeneration flow rate Qg is 0, in other words, when the regeneration-flow-rate regulation valve 84 is closed.

$$Qg\ \max=\mathrm{Max}\{Qv\ \max, Qh, Qap\} \tag{3}$$

The maximum allowable flow rate Qvmax herein is the maximum value of a flow rate of hydraulic fluid allowed to pass through the regeneration-flow-rate regulation valve 84 with its maximum opening degree, being expressed by the following Expression (4), wherein a flow rate coefficient of the regeneration-flow-rate regulation valve 84 is represented as Cvg and the maximum opening area as Agmax.

$$Qv\ \max=Cvg\times Ag\ \max\times\sqrt{(P2-P3)} \tag{4}$$

Although the target regeneration flow rate Qgr can be set to anyone within a range not more than the maximum regeneration flow rate Qgmax, setting the target regeneration flow rate Qgr to a value close to the maximum regeneration flow rate Qgmax, i.e., as large a value as possible within the allowable range, allows the effect of suppressing the required displacement volume of the accumulator 42 to be enhanced.

On the basis of thus determined target regeneration flow rate Qgr, it is possible to determine an opening degree Agr of the regeneration-flow-rate regulation valve 84 according to Expression (5) set forth below.

$$Agr=Qgr/[Cvg\times\sqrt{(P2-P3)}] \tag{5}$$

If the target regeneration flow rate Qgr is set to be a value larger than 0, it is necessary to bring the discharge flow rate Qh from the hydraulic cylinder 10 close to the target discharge flow rate Qhr corresponding to the target speed Vr regardless of the regeneration via the regeneration-flow-rate regulation valve 84 in order to bring the actuating speed (lowering speed) of the hydraulic cylinder 10 close to the target speed Vr irrespective of the target regeneration flow rate Qgr. This can be achieved by only regulating the opening degree of the accumulation valve 44 so as to bring the flow rate Qa in the accumulation valve 44 close to a target introduction flow rate Qagr=Qhr−Qp−Qgr, the target introduction flow rate Qagr being determined for regeneration. Here, Qp represents the pump flow rate corresponding to the regeneration displacement volume set at Step S4 similarly to the first embodiment.

On the other hand, the regenerative pump control section 68 performs control of reducing a discharge flow rate of a regenerative hydraulic pump, for example, the auxiliary hydraulic pump 24A, by the target regeneration flow rate Qgr (Step S54). Specifically, when the number of revolutions in the auxiliary hydraulic pump 24A is represented as Nap, the displacement volume qapg of the auxiliary hydraulic pump 24A is set to be one given by the following Expression (6).

$$qapg=(Qap-Qgr)/Nap \tag{6}$$

This control makes it possible to stabilize a total flow rate of hydraulic fluid supplied to the hydraulic cylinder 10A, which is a regenerative hydraulic actuator, during the raising drive irrespective of presence or absence of the regeneration flow rate and an amount thereof. This allows energy corresponding to a pressure on the discharge side of the hydraulic cylinder 10, the pressure being raised by a self-weight of the load 2 of the hydraulic cylinder 10, to be efficiently utilized for driving the hydraulic cylinder 10A as a regenerative hydraulic actuator in the raising direction. This further makes it possible to prevent cavitation and pressure rise due to an unbalance between the flow rate of hydraulic fluid supplied to the head side chamber of the hydraulic cylinder 10 and the flow rate of hydraulic fluid discharged from the rod side chamber.

The regenerative pump control section 68 may perform control of reducing a discharge flow rate of the hydraulic pump 20A, in place of the discharge flow rate of the auxiliary hydraulic pump 24A, by an amount of the target regeneration flow rate. If an actual regeneration flow rate can be detected, it is also possible to perform control of reducing the discharge flow rate of the hydraulic pump 20A or the auxiliary hydraulic pump 24A by the amount of the regeneration flow rate.

On the other hand, when a raising drive command is issued for the closed circuit 4 in the fourth embodiment (NO at Step S1), the speed control section 64 causes the regeneration-flow-rate regulation valve 84, in addition to the accumulation valve 44, to be closed (Step S7A); otherwise, the speed control section 64 performs the same control as in the first embodiment (Steps S6, S8, S9).

In the apparatus shown in FIG. 6, both the hydraulic cylinder 10 as a hydraulic actuator and the hydraulic cylinder 10A as a regenerative hydraulic actuator are disposed in an upward attitude, i.e., such an attitude that respective extensions of the hydraulic cylinders 10, 10A involves raising the loads 2, 2A connected thereto against their self-weights, respectively. However, respective attitudes of the hydraulic cylinders 10, 10A do not have to be the same.

Figure 9:
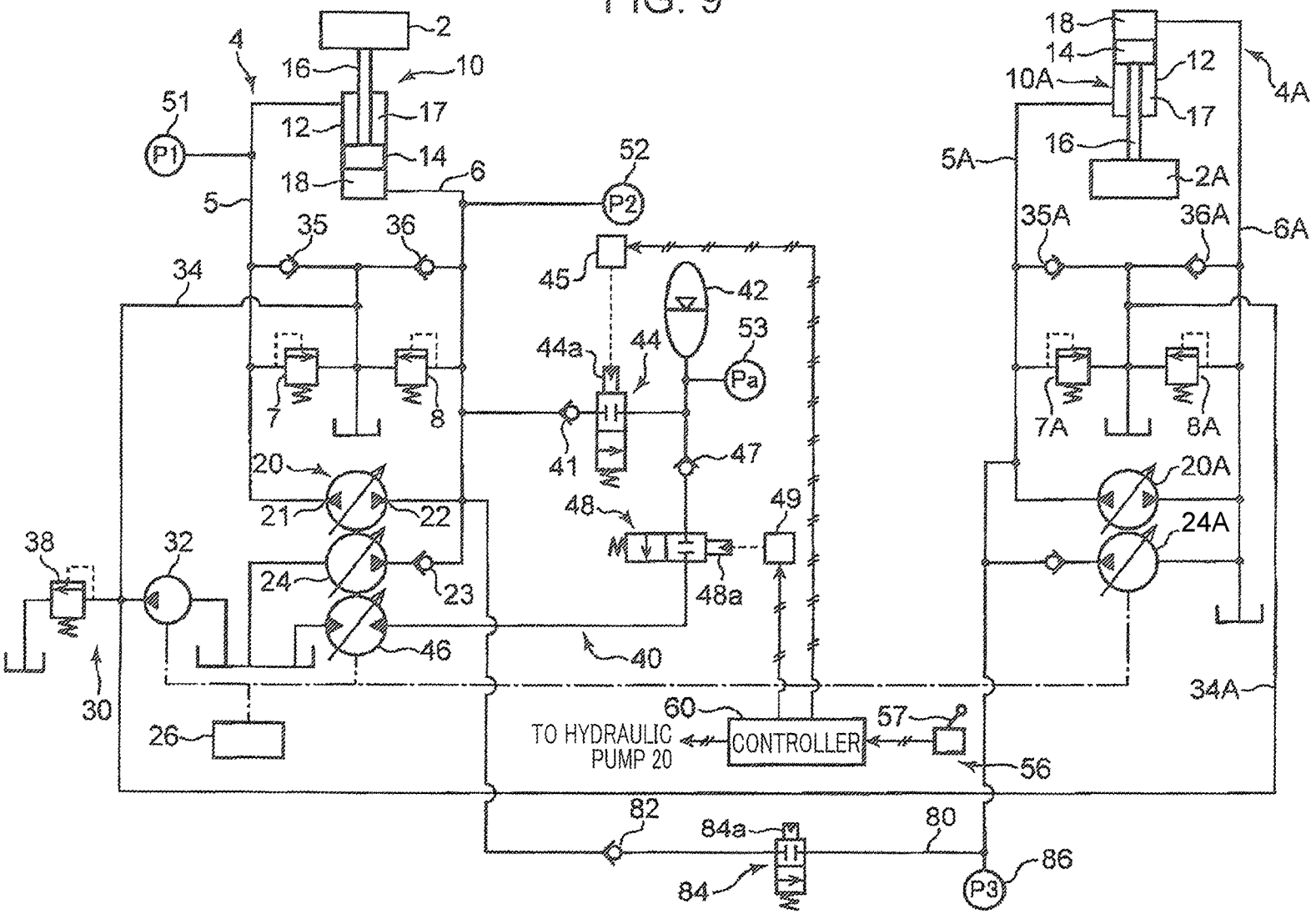
FIG. 9 is a circuit diagram showing a hydraulic drive apparatus according to a fifth embodiment of the present invention.

For example, as shown in FIG. 9 as the fifth embodiment, the hydraulic cylinder 10A as a regenerative hydraulic actuator may be arranged in a downward attitude, which is such an attitude that the rod 16 of the hydraulic cylinder 10A extends downward from a piston 14 to raise the load 2A against a self-weight thereof involved by the contraction of the hydraulic cylinder 10A. In this case, the supply of hydraulic fluid from the hydraulic pumps 20A, 24A to the hydraulic cylinder 10A for the raising drive is performed through the first pipe 5A leading to the rod side chamber 17 of the hydraulic cylinder 10A and, therefore, it is preferable to connect the regenerative pipe 80 to the first pipe 5A.

The regenerative hydraulic circuit is not limited to such a closed circuit as the closed circuit 4A, that is, not limited to a circuit in which hydraulic fluid discharged by a regenerative hydraulic pump circulates between the regenerative hydraulic pump and a regenerative hydraulic actuator. The regenerative hydraulic circuit may be an open circuit, that is, a circuit in which a regenerative hydraulic pump sucks hydraulic fluid in a tank and discharges it, while hydraulic fluid discharged from a regenerative hydraulic actuator is returned to the tank.

Figure 10:
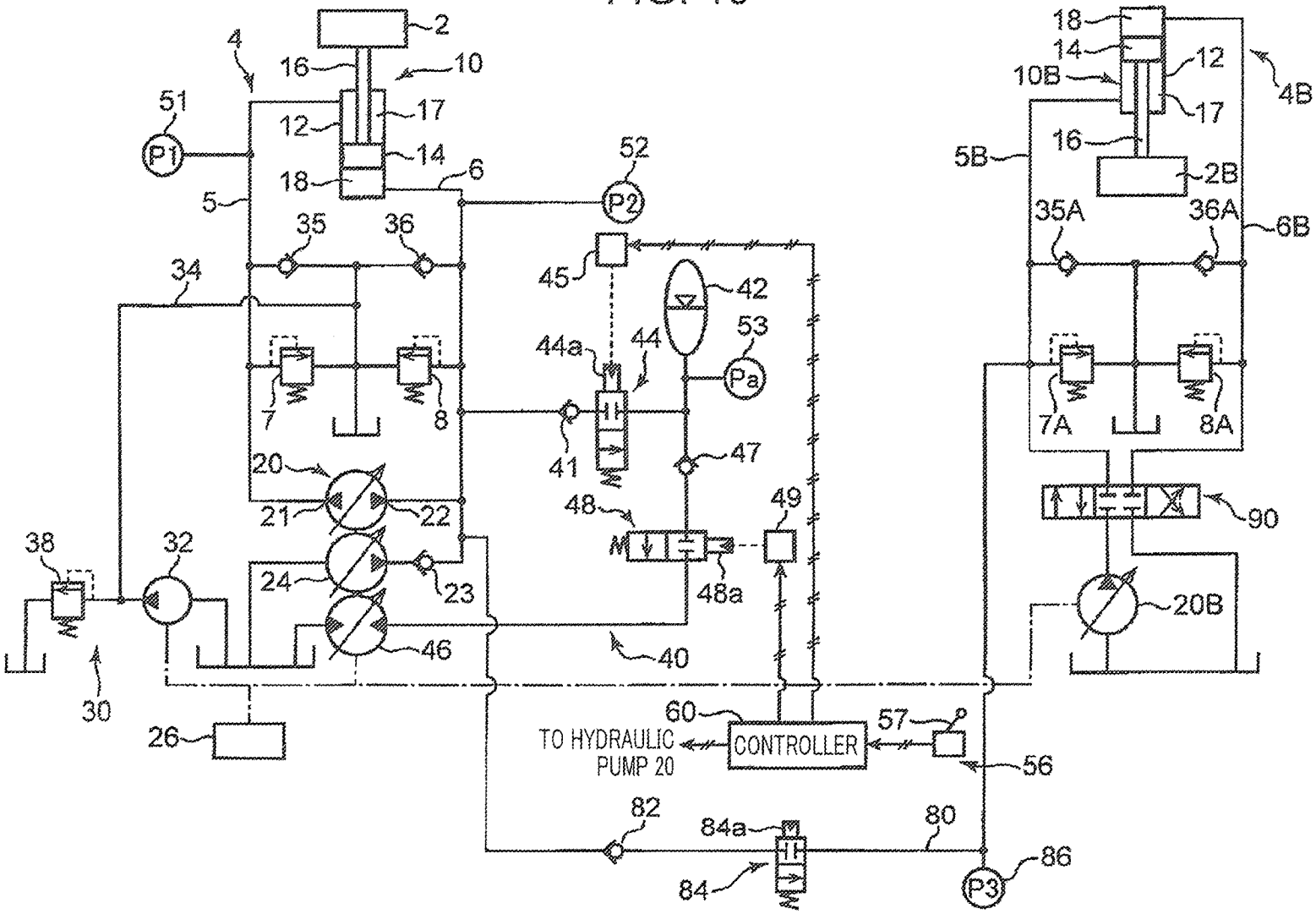
FIG. 10 is a circuit diagram showing a hydraulic drive apparatus according to a sixth embodiment of the present invention.

An example thereon is shown as a sixth embodiment in FIG. 10. The apparatus according to the sixth embodiment includes an open circuit 4B as a regenerative hydraulic circuit. The open circuit 4B includes a hydraulic pump 20B as a regenerative hydraulic pump, a hydraulic cylinder 10B as a regenerative hydraulic actuator, and a control valve 90 interposed between the hydraulic pump 20B and the hydraulic cylinder 10B.

Similarly to the hydraulic cylinder 10A shown in FIG. 9, the hydraulic cylinder 10B is arranged to have a rod 16 directed downward, the rod 16 having a distal end to which a load 2B is connected. The hydraulic cylinder 10B, thus, contracts to raise the load 2B against a self-weight thereof and contracts to lower the load 2B in a direction of the self-weight of the load 2B.

The control valve 90 is configured with a three-position hydraulic selector valve having a neutral position, a raising drive position, and a lowering drive position. In the neutral position, the control valve 90 blocks the hydraulic cylinder 10B from the hydraulic pump 20B. In the raising drive position, the control valve 90 allows hydraulic fluid discharged by the hydraulic pump 20B to be supplied to a rod side chamber 17 of the hydraulic cylinder 10B through a first pipe 5B to contract the hydraulic cylinder 10B while leading hydraulic fluid discharged into a second pipe 6B from a head side chamber 18 of the hydraulic cylinder 10B to a tank. In the lowering drive position, the control valve 90 allows hydraulic fluid discharged by the hydraulic pump 20B to be supplied to the head side chamber 18 of the hydraulic cylinder 10B through the second pipe 6B to extend the hydraulic cylinder 10B while leading hydraulic fluid discharged into the first pipe 5B from the rod side chamber 17 of the hydraulic cylinder 10B to a tank.

In the open circuit 4B, a regenerative pipe 80 is connected to a pipe for supplying hydraulic fluid for raising drive, namely, the first pipe 5B. This configuration makes it possible to utilize energy of a high-pressure hydraulic fluid discharged from the hydraulic cylinder 10 during the lowering drive in the closed circuit 4 for raising drive in the open circuit 4B, that is, to perform effective regeneration, even in the case where the regenerative hydraulic circuit is the open circuit 4B.

Figure 11:
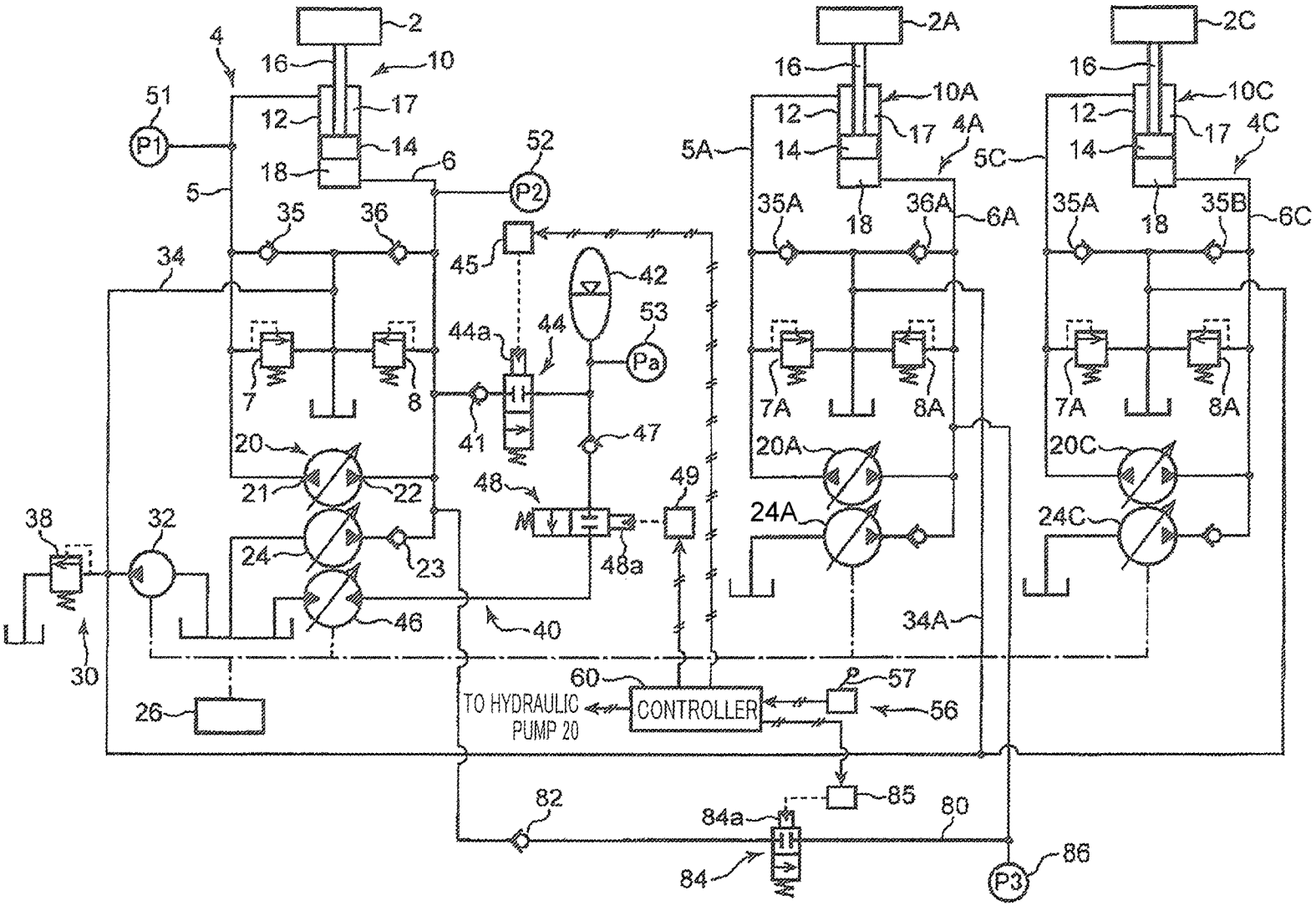
FIG. 11 is a circuit diagram showing a hydraulic drive apparatus according to a seventh embodiment of the present invention.

The present invention does not exclude further addition of another circuit to the above-described hydraulic circuit. An example thereon is shown in FIG. 11 as a seventh embodiment. The apparatus shown in FIG. 11 includes a closed circuit 4C in addition to the closed circuit 4 and the closed circuit 4A shown in FIG. 6. The closed circuit 4C includes hydraulic pumps 20C, 24C and a hydraulic cylinder 10C, which are similar to the hydraulic pumps 20A, 24A and the hydraulic cylinder 10A in the closed circuit 4A, respectively, wherein the hydraulic pumps 20C, 24C are connected to a common drive source 26 shared by hydraulic pumps 20, 24, 20A, and 24A.

In the embodiment, the regeneration selector valve 48 in the closed circuit 4 is preferably configured to be opened when driving at least one of the hydraulic pumps 20, 24, 20A, 24A, 20C and 24C which are connected to the drive source 26 requires assist of the drive source 26.

The present invention is not limited to the above-described embodiments and the elements of the embodiments can be appropriately combined or various modifications can be made without departing from the gist of the present invention. In particular, in the embodiments disclosed here, matters not explicitly disclosed, for example, an operation condition, a measurement condition, various parameters, a size, a weight and a volume of a structure and the like do not depart from an ordinary ability of a person skilled in the art and adopt values that can be easily assumed by those having an ordinary skill in the art.

As described above, provided is a hydraulic drive apparatus for hydraulically actuating a load, the hydraulic drive apparatus including: a hydraulic actuator which is connected to the load and is operated so as to actuate the load; a hydraulic pump configured to discharge hydraulic fluid and having a variable flow rate, the hydraulic pump being connected to the hydraulic actuator so as to configure a closed circuit in which hydraulic fluid discharged from the hydraulic pump is supplied to the hydraulic actuator and hydraulic fluid discharged from the hydraulic actuator is returned to a suction side of the hydraulic pump; a drive source which drives the hydraulic pump to cause the hydraulic pump to discharge hydraulic fluid; a charge circuit which feeds supplemental hydraulic fluid to the closed circuit when a pressure in the closed circuit is lower than a predetermined set pressure; an accumulator connected to the closed circuit so as to be able to receive hydraulic fluid discharged from the hydraulic actuator during a lowering drive in which the hydraulic actuator is operated so as to actuate the load in a lowering direction including a component of a direction in which gravity acts on the load; an accumulator-flow-rate regulator interposed between the closed circuit and the accumulator to change a flow rate of hydraulic fluid from the closed circuit to the accumulator; a regeneration actuator which is driven by energy of hydraulic fluid accumulated by the accumulator to convert the energy into motive power; a regeneration selector valve interposed between the accumulator and the regeneration actuator and being switchable between a position for allowing hydraulic fluid to be supplied from the accumulator to the regeneration actuator and a position for cutting off the supply; a pump control section which limits the discharge flow rate of the hydraulic pump to a predetermined regeneration flow rate during the lowering drive; and a speed control section which operates the accumulator-flow-rate regulator so as to bring an actuating speed of the hydraulic actuator close to a target speed during the lowering drive.

According to the apparatus, during the lowering drive, i.e., when the hydraulic actuator is operated in a direction of actuating the load in the lowering direction, the pump discharge speed control section limits the discharge flow rate of the hydraulic pump to a predetermined regeneration flow rate. On the other hand, hydraulic fluid discharged from the hydraulic actuator is introduced into the accumulator via the accumulator-flow-rate regulator, thus the excess hydraulic fluid being accumulated in the accumulator. Furthermore, the speed control section operates the accumulator-flow-rate regulator so as to bring the actuating speed of the hydraulic actuator in the lowering direction close to the target speed to thereby properly control the actuating speed of the hydraulic actuator, and in turn, the speed of the load in the lowering direction. After the hydraulic fluid has been received by the accumulator, the regeneration selector valve is opened as appropriate to allow the hydraulic fluid in the accumulator to be supplied to the regeneration actuator. This allows the regeneration actuator to convert the energy possessed in the hydraulic fluid into motive power, thereby making it possible to recover kinetic energy and potential energy of the load during the lowering drive, that is, to regenerate.

For example, the speed control section is preferably configured to operate the accumulator-flow-rate regulator so as to bring an accumulator introduction flow rate close to a target introducing flow rate, the accumulator introduction flow rate being a flow rate of hydraulic fluid introduced from the hydraulic actuator to the accumulator, the target introducing flow rate being a difference between a target discharge flow rate which is a flow rate of the discharged hydraulic fluid corresponding to the target speed and a pump absorption volume equivalent to the regeneration displacement volume of the hydraulic pump. This enables the flow rate of hydraulic fluid actually discharged from the hydraulic actuator to be controlled to be the flow rate corresponding to the target speed without detection of the flow rate of the hydraulic fluid.

More specifically, it is preferable that the hydraulic drive apparatus further includes: a discharge pressure detector configured to detect a discharge pressure which is a pressure of discharge hydraulic fluid discharged from the hydraulic actuator operated in the lowering direction; and an accumulator pressure detector configured to detect an accumulator pressure which is a pressure of hydraulic fluid introduced into the accumulator, wherein the speed control section operates the accumulation-flow-rate regulator so as to bring the accumulator introduction flow rate obtained from a difference between the discharge pressure and the accumulator pressure close to the target introducing flow rate. The apparatus is able to perform a control of bringing the actuating speed of the hydraulic actuator during the lowering drive close to the target speed with a simple configuration only for detecting the pressure of discharged hydraulic fluid and the accumulator pressure.

Alternatively, in the case where the accumulator-flow-rate regulator includes: a variable aperture restrictor having a variable opening area; and a flow rate regulation valve operable to make an open-and-close action so as to keep a cross differential pressure which is a difference between an upstream side pressure and a downstream side pressure across the variable aperture restrictor be constant, it is preferable that the speed control section is configured to operate the variable aperture restrictor so as to bring the cross differential pressure across the variable aperture restrictor into coincidence with the cross differential pressure corresponding to the target introducing flow rate. This makes it possible to perform appropriate speed control without detecting a discharge pressure or an accumulator pressure.

On the other hand, regarding the supply of hydraulic fluid from the accumulator to the regeneration actuator, it is preferable that the hydraulic drive apparatus further includes a regeneration control section which brings the regeneration selector valve into opening and closing action so as to allow hydraulic fluid to be supplied from the accumulator to the regeneration actuator when motive power generated by the regeneration actuator is required.

Specifically, it is preferable that the regeneration actuator is connected to the drive source so as to be able to assist the drive source in driving the hydraulic pump, and the regeneration control section is configured to open the regeneration selector valve so as to allow hydraulic fluid to be supplied from the accumulator to the regeneration actuator during a raising drive in which the hydraulic actuator is operated in a direction of actuating the load in a raising direction which is a direction opposite to gravity acting on the load. The apparatus allows the drive source which drives the hydraulic pump to be assisted during the raising drive in which the load is actuated against gravity, by utilization of energy recovered in the accumulator during the lowering drive in which the load is actuated in the lowering direction which is a direction not opposite to gravity acting on the load. This enables efficient utilization of regenerative energy to be realized.

The utilization of regenerative motive power is not limited to assistance in driving the hydraulic pump. For example, in the case where the drive source is connected to a hydraulic device different from the hydraulic pump to drive the hydraulic device, in addition to the hydraulic pump, the regeneration control section may be configured to open the regeneration selector valve so as to allow hydraulic fluid from the accumulator to the regeneration actuator to be supplied, when a driving force for the different hydraulic device is required. This apparatus allows long time to be spent for operating the regeneration actuator, i.e., for converting energy accumulated by the accumulator into motive power, by use of regenerative motive power also for the different hydraulic device. This makes it possible to fully spend the energy in the accumulator even with use of a relatively small type of regeneration actuator.

In the present invention, the place to which hydraulic fluid discharged from the hydraulic actuator escapes during the lowering drive is not limited to the accumulator. For example, hydraulic fluid discharged from the hydraulic actuator during the lowering drive may escape to both the accumulator, and a regenerative hydraulic circuit other than the closed circuit including the hydraulic actuator and the hydraulic pump. Specifically, desirable is that the hydraulic drive apparatus further includes a regeneration-flow-rate regulator which is interposed between the closed circuit and the regenerative hydraulic circuit to change a regeneration flow rate which is a flow rate of hydraulic fluid supplied from the closed circuit to the regenerative hydraulic circuit, wherein the speed control section is configured to operate the accumulator-flow-rate regulator and the regeneration-flow-rate regulator so as to bring an actuating speed of the hydraulic actuator close to the target speed during the lowering drive.

This apparatus allows a part of hydraulic fluid discharged from the hydraulic actuator during the lowering drive to escape to not only the accumulator but also the regenerative hydraulic circuit different from the accumulator to thereby allow the accumulator introduction flow rate required for bringing the actuating speed of the hydraulic actuator close to the target speed during the lowering drive, that is, a flow rate of hydraulic fluid introduced into the accumulator, to be small; this allows the required capacity of the accumulator to be decreased.

In this case, it is more desirable that the hydraulic drive apparatus further includes a pressure detection section that provides information on which pressure is higher, a discharge pressure that is a pressure of discharged hydraulic fluid from the hydraulic actuator during the lowering drive and an introduction portion pressure that is a pressure in a portion of the regenerative hydraulic circuit into which portion hydraulic fluid is introduced via the regeneration-flow-rate regulator in the regenerative hydraulic circuit, wherein the speed control section is configured to allow hydraulic fluid to pass through the regeneration-flow-rate regulator only when the discharge pressure is higher than the introduction part pressure. This prevents hydraulic fluid from a back flow from the regenerative hydraulic circuit to the closed circuit, more reliably, when a discharge pressure is lower than an introduction part pressure.

In the case where the regenerative hydraulic circuit includes a regenerative hydraulic pump formed of a hydraulic pump being operable to discharge hydraulic fluid and having a variable discharge flow rate and a regenerative hydraulic actuator driven by hydraulic fluid discharged by the regenerative hydraulic pump, it is preferable that the hydraulic drive apparatus further includes a regenerative pump control section which reduces a discharge flow rate of the regenerative hydraulic pump by the regeneration flow rate regulated by the regeneration-flow-rate regulator or by a target regeneration flow rate set for the regeneration flow rate. The control performed by the regenerative pump control section enables a total flow rate of hydraulic fluid supplied to the regenerative hydraulic actuator to be stabilized, irrespective of presence/absence of a regeneration flow rate and an amount thereof.

The present application claims priorities from Japanese Patent Application (JP 2014-157865 A) filed on Aug. 1, 2014, and Japanese Patent Application (JP 2014-235334 A) filed on Nov. 20, 2014, disclosures of which are all incorporated herein by reference.

The invention claimed is:

1. A hydraulic drive apparatus for hydraulically actuating a load, the hydraulic drive apparatus comprising:

a hydraulic actuator which is connected to the load and is operated so as to actuate the load;

a hydraulic pump configured to discharge hydraulic fluid and having a variable flow rate, the hydraulic pump being connected to the hydraulic actuator so as to configure a closed circuit in which hydraulic fluid discharged from the hydraulic pump is supplied to the hydraulic actuator and hydraulic fluid discharged from the hydraulic actuator is returned to a suction side of the hydraulic pump;

a drive source which drives the hydraulic pump to cause the hydraulic pump to discharge hydraulic fluid;

a charge circuit which feeds supplemental hydraulic fluid to the closed circuit when a pressure in the closed circuit is lower than a predetermined set pressure;

an accumulator connected to the closed circuit so as to be able to receive hydraulic fluid discharged from the hydraulic actuator during a lowering drive in which the hydraulic actuator is operated so as to actuate the load in a lowering direction including a component of a direction in which gravity acts on the load;

an accumulator-flow-rate regulator interposed between the closed circuit and the accumulator to change a flow rate of hydraulic fluid from the closed circuit to the accumulator;

a regeneration actuator which is driven by energy of hydraulic fluid accumulated by the accumulator to convert the energy into motive power;

a regeneration selector valve interposed between the accumulator and the regeneration actuator, the regeneration selector valve being switchable between a position for allowing hydraulic fluid to be supplied from the accumulator to the regeneration actuator and a position for cutting off the supply;

a pump control section which limits the discharge flow rate of the hydraulic pump to a predetermined regeneration flow rate during the lowering drive; and a speed control section which operates the accumulator-flow-rate regulator so as to bring an actuating speed of the hydraulic actuator close to a target speed during the lowering drive, wherein the speed control section operates the accumulator-flow-rate regulator so as to bring an accumulator introduction flow rate close to a target introducing flow rate, the accumulator introduction flow rate being a flow rate of hydraulic fluid introduced from the hydraulic actuator to the accumulator, the target introducing flow rate being a difference between a target discharge flow rate which is a flow rate of the discharged hydraulic fluid corresponding to the target speed and a pump absorption volume equivalent to the regeneration displacement volume of the hydraulic pump.

2. The hydraulic drive apparatus according to claim 1, further comprising: a discharge pressure detector configured to detect a discharge pressure which is a pressure of a discharge hydraulic fluid discharged from the hydraulic actuator operated in the lowering direction; and an accumulator pressure detector configured to detect an accumulator pressure which is a pressure of hydraulic fluid introduced into the accumulator, wherein the speed control section operates the accumulator-flow-rate regulator so as to bring the accumulator introduction flow rate obtained from a difference between the discharge pressure and the accumulator pressure close to the target introducing flow rate.

3. The hydraulic drive apparatus according to claim 1, wherein the accumulator-flow-rate regulator includes: a variable aperture restrictor having a variable opening area; and a flow rate regulation valve operable to make an open-and-close action so as to keep a cross differential pressure which is a difference between an upstream side pressure and a downstream side pressure across the variable aperture restrictor be constant, the speed control section being configured to operate the variable aperture restrictor so as to bring the cross differential pressure across the variable aperture restrictor into coincidence with a cross differential pressure corresponding to the target introducing flow rate.

4. The hydraulic drive apparatus according to claim 1, further comprising a regeneration control section which brings the regeneration selector valve into opening and closing action so as to allow hydraulic fluid to be supplied from the accumulator to the regeneration actuator when motive power generated by the regeneration actuator is required.

5. The hydraulic drive apparatus according to claim 4, wherein the regeneration actuator is connected to the drive source so as to be able to assist the drive source in a drive of the hydraulic pump, and the regeneration control section is configured to open the regeneration selector valve so as to allow hydraulic fluid to be supplied from the accumulator to the regeneration actuator during a raising drive in which the hydraulic actuator is operated in a direction of actuating the load in a raising direction which is a direction opposite to gravity acting on the load.

6. The hydraulic drive apparatus according to claim 4, wherein the drive source is connected to a hydraulic device different from the hydraulic pump to drive the hydraulic device, and the regeneration control section is configured to open the regeneration selector valve so as to allow hydraulic fluid from the accumulator to the regeneration actuator to be supplied when a driving force for the different hydraulic device is required.

7. The hydraulic drive apparatus according to claim 1, further comprising: a regenerative hydraulic circuit different from the closed circuit; and a regeneration-flow-rate regulator which is interposed between the closed circuit and the regenerative hydraulic circuit to change a regeneration flow rate which is a flow rate of hydraulic fluid supplied from the closed circuit to the regenerative hydraulic circuit, wherein the speed control section operates the accumulator-flow-rate regulator and the regeneration-flow-rate regulator so as to bring an actuating speed of the hydraulic actuator close to the target speed during the lowering drive.

8. The hydraulic drive apparatus according to claim 7, further comprising a pressure detection section that provides information on which pressure is higher, a discharge pressure that is a pressure of discharged hydraulic fluid from the hydraulic actuator during the lowering drive or an introduction portion pressure that is a pressure in a portion of the regenerative hydraulic circuit into which portion hydraulic fluid is introduced via the regeneration-flow-rate regulator in the regenerative hydraulic circuit, wherein the speed control section is configured to allow hydraulic fluid to pass through the regeneration-flow-rate regulator only when the discharge pressure is higher than the introduction part pressure.

9. The hydraulic drive apparatus according to claim 7, wherein the regenerative hydraulic circuit includes a regenerative hydraulic pump formed of a hydraulic pump being operable to discharge hydraulic fluid and having a variable discharge flow rate and a regenerative hydraulic actuator driven by hydraulic fluid discharged by the regenerative hydraulic pump, the hydraulic drive apparatus further including a regenerative pump control section which reduces a discharge flow rate of the regenerative hydraulic pump by the regeneration flow rate regulated by the regeneration-flow-rate regulator or by a target regeneration flow rate set for the regeneration flow rate.

* * * * *